US008240928B2

(12) United States Patent
Tsugaru et al.

(10) Patent No.: US 8,240,928 B2
(45) Date of Patent: Aug. 14, 2012

(54) PRINTER

(75) Inventors: Hiroyuki Tsugaru, Saitama (JP); Tetsuya Yamamoto, Tokyo (JP); Katsutoshi Mukaijima, Tokyo (JP); Gen Matsushima, Tokyo (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 326 days.

(21) Appl. No.: 12/722,865

(22) Filed: Mar. 12, 2010

(65) Prior Publication Data

US 2010/0247217 A1 Sep. 30, 2010

(30) Foreign Application Priority Data

Mar. 30, 2009 (JP) ..... 2009-082828

(51) Int. Cl.
*B41J 11/00* (2006.01)

(52) U.S. Cl. ..... 400/583; 400/582

(58) Field of Classification Search ..... 400/583
See application file for complete search history.

(56) References Cited

U.S. PATENT DOCUMENTS

| | | | | |
|---|---|---|---|---|
| 3,994,449 | A * | 11/1976 | Wales | 242/563.2 |
| 4,204,180 | A * | 5/1980 | Usui et al. | 335/205 |
| 5,820,068 | A | 10/1998 | Hosomi et al. | |
| 5,884,861 | A * | 3/1999 | Hosomi et al. | 242/563 |
| 6,352,381 | B1 * | 3/2002 | Gonmori et al. | 400/615.2 |
| 6,502,784 | B1 * | 1/2003 | Sato | 242/563 |
| 6,511,240 | B2 | 1/2003 | Yamada | |
| 6,629,666 | B2 * | 10/2003 | Lee et al. | 242/563 |
| 7,354,210 | B2 * | 4/2008 | Seo et al. | 400/621 |
| 7,553,097 | B2 * | 6/2009 | Salussolia et al. | 400/613 |
| 7,553,098 | B2 * | 6/2009 | Maekawa et al. | 400/613 |
| 2002/0109037 | A1 | 8/2002 | Mizuno | |

FOREIGN PATENT DOCUMENTS

| | | |
|---|---|---|
| JP | 2001-002296 | 1/2001 |
| JP | 2001-130808 | 5/2001 |
| JP | 2001-171866 | 6/2001 |
| JP | 2002-234223 | 8/2002 |
| JP | 3480225 | 10/2003 |
| JP | 2004-262588 | 9/2004 |
| JP | 3785288 | 3/2006 |
| JP | 3128350 | 1/2007 |

OTHER PUBLICATIONS

Japanese Patent Office "Office Action" issued for corresponding Japanese Patent Application No. 2009-082828, dated Jan. 21, 2011. Partial English translation attached.

Notice of Rejection issued on Feb. 22, 2012, by the Japanese Patent Office for corresponding Japanese Patent Application No. 2009-82828, with partial English translation.

* cited by examiner

*Primary Examiner* — Anthony Nguyen
(74) *Attorney, Agent, or Firm* — Myers Wolin, LLC

(57) ABSTRACT

A recording medium accommodating unit 301 that accommodates a recording medium 202 wound in a roll includes a first detecting unit that detects that a core part in the center of the recording medium 202 has reached a predetermined position in consequence of consumption of the recording medium 202 when a printer 201 is in a first installation state, a second detecting unit that detects that the core part in the center of the recording medium 202 has reached a predetermined position in consequence of the consumption of the recording medium 202 when the printer 201 is in a second installation state that is different from the first installation state, and a moving mechanism that moves the first and the second detecting units to positions activating detection by one among the first and the second detecting units.

13 Claims, 13 Drawing Sheets

PRINTER

CROSS-REFERENCE TO RELATED APPLICATIONS

This application is based upon and claims the benefit of priority of the prior Japanese Patent Application No. 2009-082828, filed on Mar. 30, 2009, now pending, the entire contents of which are herein wholly incorporated by reference.

BACKGROUND OF THE INVENTION

1. Field of the Invention

The present invention relates to a printer that holds a recording medium wound in a roll and that prints on the recording medium.

2. Description of the Related Art

For example, among printers that print on a recording medium wound in a roll, are those capable of being used in changeable installation orientations such as "upright" or "horizontal". Among such printers are those facilitating simplification of recording medium replacement by employing a configuration that does not support axially a core part of the recording medium wound in a roll but supports, from below, the recording medium wound in a roll.

In printers employing a configuration to support the recording medium wound in a roll from below, the position at which the recording medium is stable in the printer differs according to the installation orientation of the printer. Accordingly, a detection point suitable for detecting that the remaining amount of the recording medium is a predetermined amount or less, i.e., a near end, differs according to the installation orientation of the printer.

Conventionally, as a technology to realize near end detection, for example, a printer includes a housing unit that houses a roll of recording paper and includes multiple guiding units each positioning the recording paper at a predetermined position as the diameter of the roll of the recording paper becomes smaller, and a paper end detecting unit that detects that the remaining amount of the recording paper is a predetermined amount or less, by a sensor entering a space of a core part of the recording paper, where the paper end detecting unit is rotatably attached to the accommodating unit such that each sensor corresponds to each of the guiding units (see, e.g., Patent Document 1 below).

Further, as a technology to realize near end detection, for example, a printer includes a printer main body whose installation orientation is changeable in two ways, a printing unit equipped in the printer main body, a roll paper housing unit equipped in the printer main body and having a mounting surface supporting a circumferential surface of the roll paper irrespective of changes in the installation orientation of the printer main body, and a roll paper displacement detecting unit that detects a displacement of a central portion of the roll paper caused by the weight of the roll paper, where the roll paper displacement detecting unit includes a mechanism having a first and a second actuator that can swing about a pivot rotatably fitted to the printer main body, that extend in two different directions from the pivot, and that are displaced according to displacement of a central portion varying in two ways and by the weight of the roll paper, and a sensor whose output signal is switched according to variations in state associated with the rotation of the pivot commonly generated by both of the displacements of the first and the second actuators (see, e.g., Patent Document 2 below).

For example, a printer including a paper holder that accommodates a roll of paper and that includes a guiding unit positioning the paper, whose diameter decreases, at a predetermined accommodation position, and a paper end detecting unit that detects that the remaining amount of the paper is a predetermined amount or less by a sensor contacting an end surface of the paper accommodated in the paper holder, where the printer further includes multiple guiding units corresponding to installation states of the printer, and multiple sensors corresponding to the guiding units. The sensors are disposed in a range formed by a trace of the roll center formed at each step of the diameter reduction of the paper, according to the guiding units, and the inner face of the paper holder connecting the guiding units (see, e.g., Patent Document 3 below).

[Patent Document 1] Japanese Patent Publication No. 3480225

[Patent Document 2] Japanese Patent Publication No. 3785288

[Patent Document 3] Japanese Patent Application Laid-Open Publication No. 2002-234223

In the conventional technique described in Patent Document 1, the paper end detecting unit must be rotated according to the installation orientation each time the installation orientation of the printer is changed. Therefore, a problem arises in that the setting operation concerning the detection of the near end is troublesome.

In the conventional technique described in Patent Document 2, the first and the second actuators are integrated to be one member. Therefore, a problem arises in that the detection precision of each of the actuators cannot be adjusted individually. Further, a problem arises in that the precision in detecting the near end cannot be adjusted for each installation orientation.

In the conventional technique described in Patent Document 3, when the position of the roll paper in the paper holder changes as the paper is consumed, i.e., when the roll paper irregularly moves in the paper holder, detection accuracy is degraded. Therefore, a problem arises in that it is difficult to secure excellent accuracy in detecting the near end.

For example, some users of the printer may determine the amount remaining of a recording medium wound in a roll by visually observing a marking provided at an end portion (the starting portion of the winding) of the recording medium, and may not use the function of near end detection. In this case, the detecting and notification of the near end executed by the printer are rather troublesome and therefore, the function of near end detection may be deactivated.

In the conventional techniques described in Patent Documents 1 to 3, an operation to deactivate the function of near end detection must be executed using control by software to deactivate the function of near end detection. Therefore, a problem arises in that the operation to deactivate the function of near end detection is troublesome.

To solve the problems associated with the above conventional techniques, an object of the present invention is to provide a printer that may easily and assuredly detect that the remaining amount of the recording medium is a predetermined amount or less (a near end), irrespective of the installation orientation of the printer.

To solve the problems associated with the above conventional techniques, another object of the present invention is to provide a printer that improves general versatility.

SUMMARY OF THE INVENTION

To solve the problems above and achieve an object, a printer according to the present invention is printer that supplies a recording medium wound in a roll, from a recording medium accommodating unit accommodating the recording medium to a printing unit and that prints on the recording medium, where the recording medium accommodating unit is formed by a first recording medium holding unit that holds the recording medium when the printer is in a first installation state and a second recording medium holding unit that holds the recording medium when the printer is in a second installation state that is different from the first installation state, and the recording medium accommodating unit includes a first detecting unit that detects that a core part in the center of the recording medium has reached a predetermined position in consequence of consumption of the recording medium held by the first recording medium holding unit; a second detecting unit that detects that the core part in the center of the recording medium has reached a predetermined position in consequence of the consumption of the recording medium held by the second recording medium holding unit; and a moving mechanism that moves the first and the second detecting units to positions activating detection by any one among the first and the second detecting units.

According to the present invention, detection by any one among the first and the second detecting units may be activated by moving the first and the second detecting units according to the installation orientation of the printer. Thereby, without any complicated control, only the detecting unit suitable for the installation orientation of the printer is activated easily and assuredly, the function of the detecting unit that is not to be activated is deactivated easily and assuredly, and the remaining amount of the recording medium may be detected based on the detection result obtained by any one among the first and the second detecting units.

The printer according to the present invention further includes a notification unit that gives notification that a remaining amount of the recording medium is a predetermined amount or less, based on a detection result obtained by the first or the second detecting unit.

According to the present invention, when the core part in the center of the recording medium reaches a predetermined position in consequence of the recording medium being consumed, the notification unit may give notification that the remaining amount of the recording medium is the predetermined amount or less. Thereby, the printer may assuredly inform the user of the printer that the remaining amount of the recording medium is the predetermined amount or less.

Further, in the printer according to the present invention, the first and the second detecting units are configured by one unit, and the moving mechanism moves the unit.

According to the present invention, the first and the second detecting units may be moved collectively. Thereby, detection by any one among the first and the second detecting units is activated easily and assuredly.

Further, in the printer according to the present invention, the first and the second detecting units each include a protrusion that biases and abuts a side surface of the recording medium, and each detects entrance of the protrusion into a space of the core part in the center of the recording medium by a movement of the core part.

According to the present invention, by determining the mechanical action of the protrusion to be detected, it may be detected that the core part in the center of the recording medium has reached the predetermined position as the recording medium is consumed, without the detection being influenced by movement of the recording medium with the conveyance of the recording medium during printing. Thereby, it may be detected accurately that the remaining amount of the recording medium is the predetermined amount or less.

Further, in the printer according to the present invention, the first and the second detecting units each optically detects that the core part in the center of the recording medium has reached the predetermined position by a movement of the core part.

According to the present invention, the physical size of each of the first and the second detecting units may be a specific size regardless of the position of the core part in the center of the recording medium varying as the recording medium is consumed. Thereby, downsizing of the mechanism concerning the detection of the remaining amount of the recording medium is facilitated.

Further, a printer according to the present invention is a printer that supplies a recording medium wound in a roll, from a recording medium accommodating unit accommodating the recording medium to a printing unit and that prints on the recording medium, where the recording medium accommodating unit is formed by a first recording medium holding unit that holds the recording medium when the printer is in a first installation state and a second recording medium holding unit that holds the recording medium when the printer is in a second installation state that is different from the first installation state, and the recording medium accommodating unit includes a first detecting unit that detects that a core part in the center of the recording medium has reached a predetermined position in consequence of consumption of the recording medium held by the first recording medium holding unit; a second detecting unit that detects that the core part in the center of the recording medium has reached a predetermined position in consequence of the consumption of the recording medium held by the second recording medium holding unit; and a moving mechanism that moves the first and the second detecting units to positions deactivating detection both the first and the second detecting units.

According to the present invention, detection by both the first and the second detecting units is deactivated by moving the first and the second detecting units. Thereby, detection by both the first and the second detecting units is deactivated easily and assuredly without any complicated control.

According to the present invention, detection by both the first and the second detecting units is deactivated according to the form of use of the printer such as the installation orientation of the printer. Therefore, the printer may cope with various forms of use.

EFFECT

According to the printer of the present invention, easily and assuredly, only the detecting unit suitable for the installation orientation of the printer is activated and therefore, an effect is achieved in that it may detected easily and assuredly that the remaining amount of the recording medium is a predetermined amount or less (a near end) regardless of the installation orientation of the printer.

According to the printer of the present invention, detection by both the first and the second detecting units is deactivated easily and assuredly, thereby effecting improvement of the general versatility of the printer.

DETAILED DESCRIPTION OF THE PREFERRED EMBODIMENTS

Preferred embodiments of a printer according to the present invention will be described in detail with reference to the accompanying drawings. In these embodiments, applications of a printer apparatus that includes a printer according to the present invention will be exemplified.

(First Embodiment)

Figure 1:
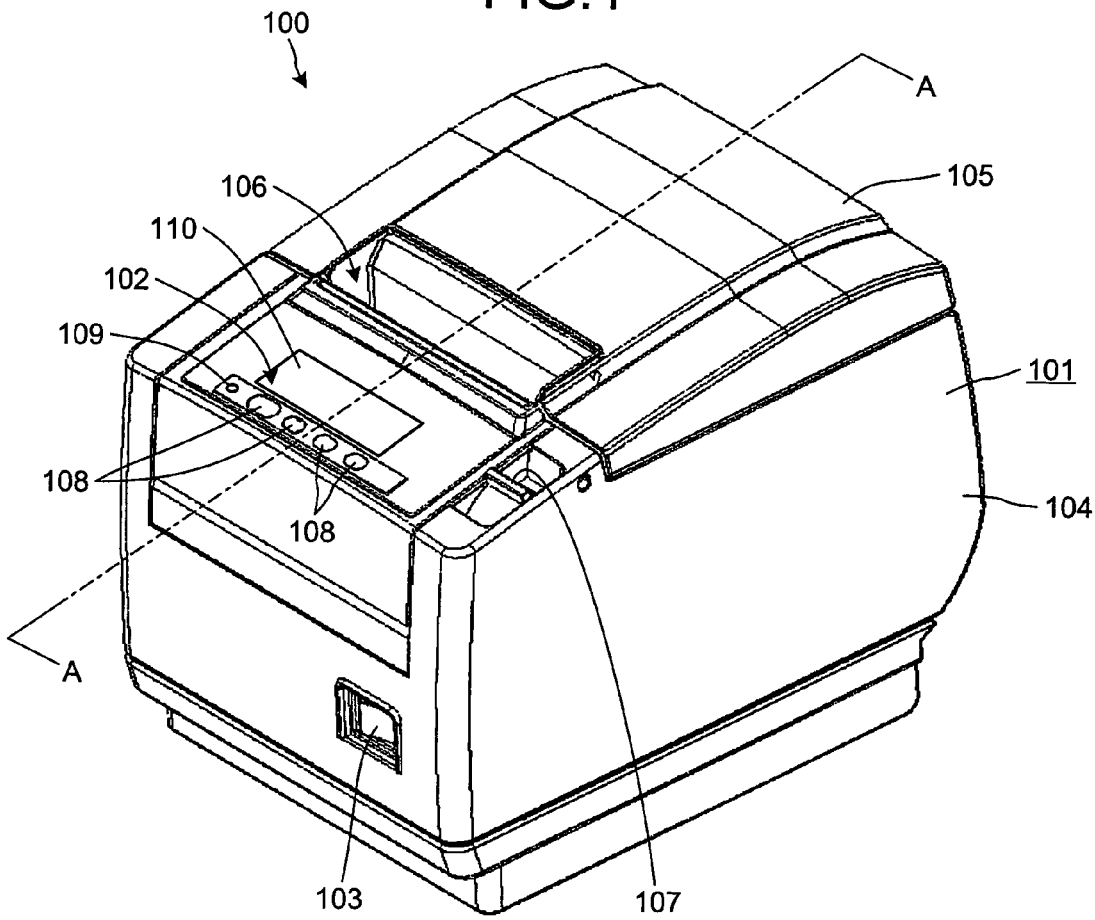
FIG. 1 is a diagram for explaining a printer apparatus according to a first embodiment of the present invention (part 1)
Figure 2:
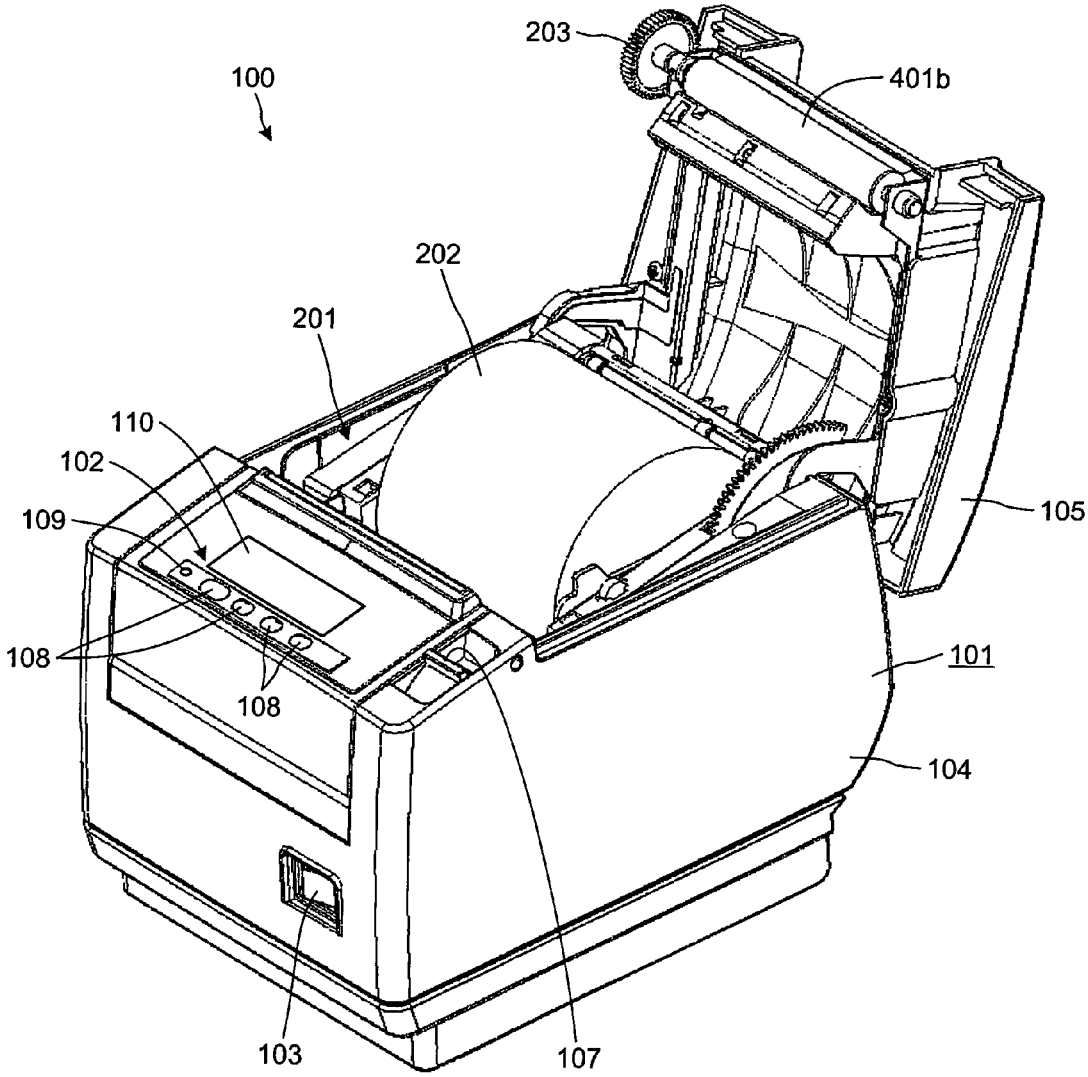
FIG. 2 is a diagram for explaining the printer apparatus according to the first embodiment of the present invention (part 2)
Figure 3:
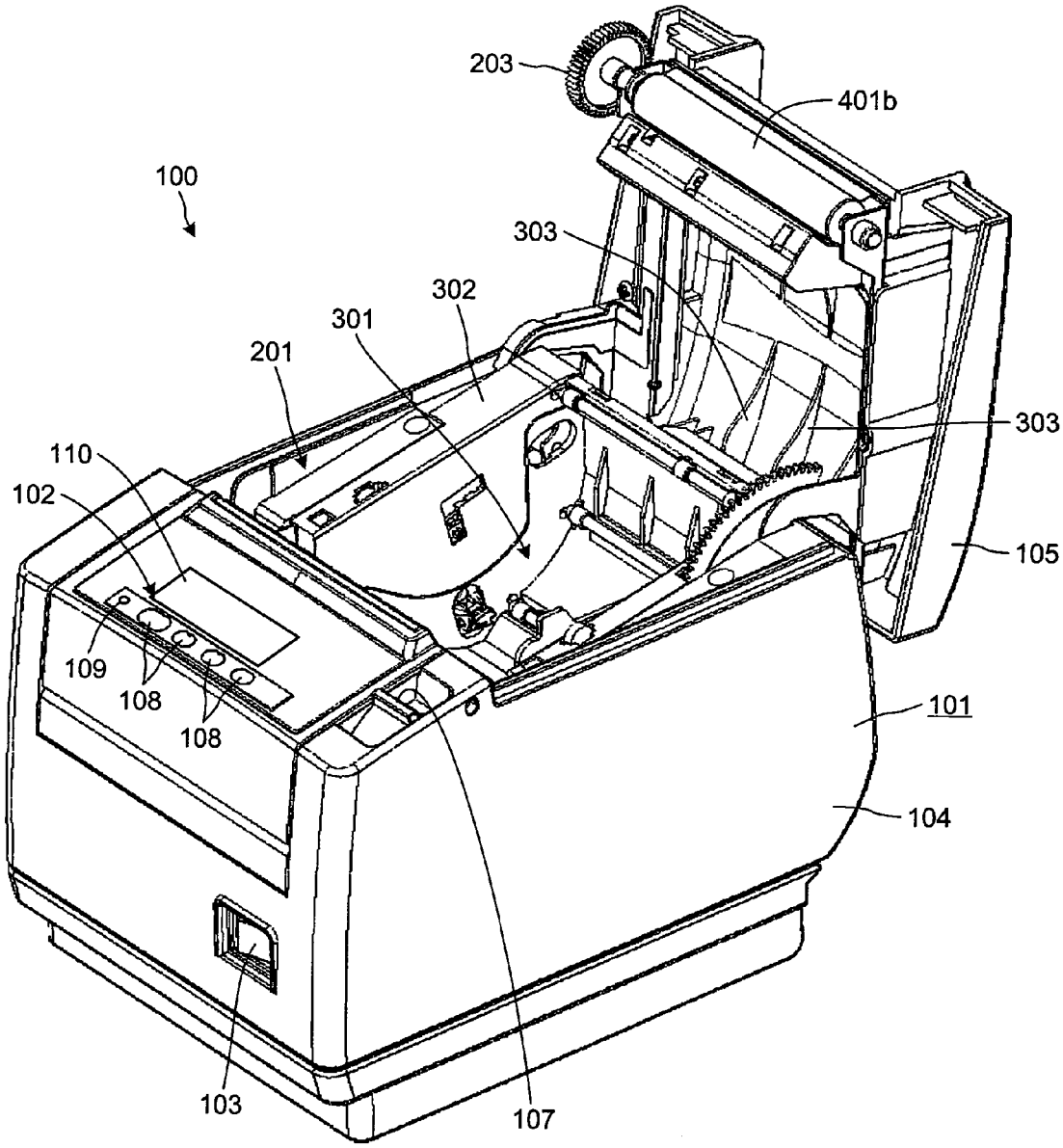
FIG. 3 is a diagram for explaining the printer apparatus according to the first embodiment of the present invention (part 3)
Figure 4:
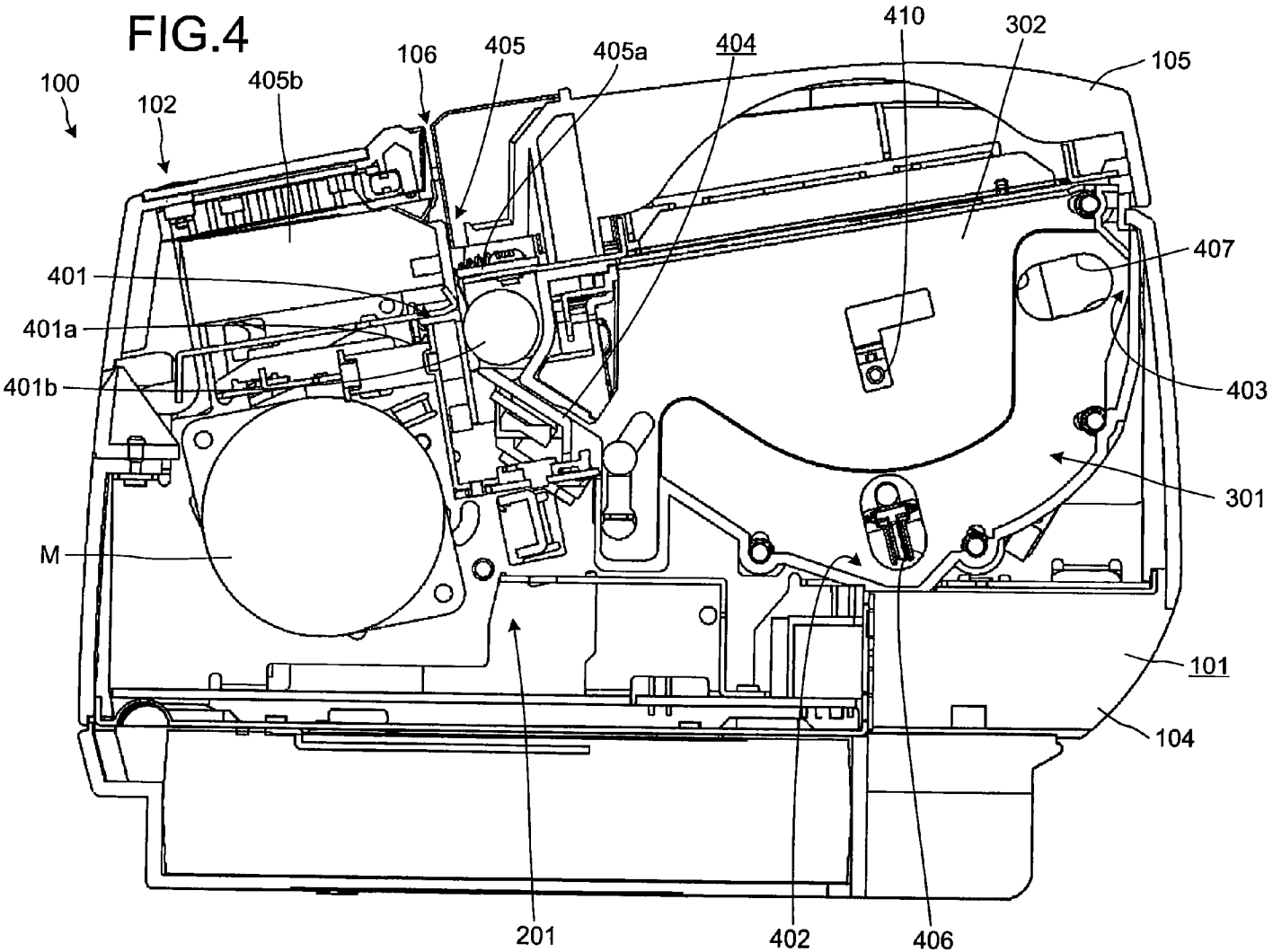
FIG. 4 is a diagram for explaining the printer apparatus according to the first embodiment of the present invention (part 4)

A printer apparatus according to a first embodiment of the present invention will be described. FIGS. 1 to 4 are diagrams for explaining the printer apparatus according to the first embodiment of the present invention. FIGS. 1 to 3 are diagrams depicting external views of the printer apparatus according to the first embodiment of the present invention. FIG. 4 depicts a cross section (along an A-A line in FIG. 1) of the printer apparatus according to the first embodiment of the present invention.

In FIGS. 1 to 4, the printer apparatus 100 according to the first embodiment of the present invention includes a casing 101 that has a substantially box shape. A printer 201 is provided inside the casing 101.

An operation panel 102 is provided at one aspect of the casing 101. The operation panel 102 is equipped with operation keys 108 for receiving various instructions for the printer apparatus 100, an LED lamp 109 that indicates the state of the printer apparatus 100, and a liquid crystal displaying unit 110 that indicates the state of the printer apparatus 100 using characters or symbols. A power switch 103 that switches the power of the printer apparatus 100 to ON and OFF is provided at another aspect of the casing 101.

When the power of the printer apparatus 100 is turned on and the printer apparatus 100 is in a printing stand-by state, when an error occurs in the printer apparatus 100, when the remaining amount of a recording medium 202 in the printer apparatus 100 is a predetermined amount or less, etc., the LED lamp 109 is lit or is caused to blink and information is displayed on the liquid crystal displaying unit 110, thereby giving notification of the above situations.

The printing apparatus 100 includes a sound output apparatus that outputs predetermined sounds. The sound output apparatus outputs spoken directions or a warning sound when an error occurs in the printer apparatus 100, when the remaining amount of the recording medium 202 in the printer apparatus 100 is a predetermined amount or less, etc.

More specifically, the sound output apparatus may be implemented by, for example, a speaker. Alternatively, more specifically, the sound output apparatus may be implemented by, for example, a buzzer. The sound output apparatus may be implemented easily using various known techniques and therefore, will not be described. The recording medium 202 has a long strip-shape and is wound from an end thereof along a longitudinal direction about a core into a roll.

The casing 101 includes a casing main body 104 that supports the printer 201, and a printer cover 105 that is coupled to the casing main body 104. The printer cover 105 is coupled to the casing main body 104 such that the interior of the casing main body 104 is enclosed and accessible via the printer cover 105.

A locking mechanism, not depicted, is provided between the casing main body 104 and the printer cover 105. When the printer cover 105 is positioned such that the interior of the casing main body 104 becomes enclosed, the locking mechanism is engaged and fixes the position of the printer cover 105 with respect to the casing main body 104.

In the casing 101, a recording medium discharge opening 106 is formed by a gap formed between the casing main body 104 and the printer cover 105 when the interior of the casing main body 104 is enclosed by the printer cover 105. The recording medium discharge opening 106 communicatively connects the interior of the casing 101 to the outside thereof, and discharges therethrough the recording medium 202 on which printing is executed by a printing unit 401 included in the printer 201 housed in the casing 101, to the outside of the casing 101. The recording medium 202 is wound in a roll and accommodated in a recording medium accommodating unit 301 included in the printer apparatus 100. The recording medium accommodating unit 301 supports an outer circumferential portion of the recording medium 202 wound in a roll.

On one aspect of the casing 101, a lock release lever 107 is provided that disengages the engagement of the locking mechanism when the lock release lever 107 is manipulated by a user, etc., of the printer apparatus 100. When the lock release lever 107 is manipulated and the engagement of the locking mechanism is disengaged, the printer cover 105 moves in a direction widening the recording medium discharge opening 106 with respect to the casing main body 104 and thereby, opens the recording medium accommodating unit 301.

In a state where the printer cover 105 is moved in an opening direction and the recording medium accommodating unit 301 is opened to the exterior, the recording medium 202 wound in a roll may be put in the recording medium accommodating unit 301, the recording medium 202 accommodated in the recording medium accommodating unit 301 may be removed from the recording medium accommodating unit 301, etc. The lock release lever 107 is manipulated when, for example, the remaining amount of the recording medium 202 accommodated in the recording medium accommodating unit 301 is an insufficient amount and a new recording medium 202 is to be set.

The recording medium accommodating unit 301 includes a box-shaped member 302 and accommodating unit ribs 303. The box-shaped member 302 is supported by the casing 101, has a bottom portion curved in a substantially semicircular shape, and has a shape of which one aspect facing toward the bottom portion is open. The accommodating unit ribs 303 are provided on the printer cover 105 and protrude toward the box-shaped member 302. The box-shaped member 302 and the accommodating unit ribs 303 form the recording medium accommodating unit 301 whose cross section is substantially circular when the printer cover 105 is fixed to the casing main body 104.

The recording medium accommodating unit 301 includes a first and a second recording medium holding units 402 and 403. The first recording medium holding unit 402 holds the recording medium 202 when the printer apparatus 100, i.e., the printer 201, is in a first installation state. The second recording medium holding unit 403 holds the recording medium 202 when the printer apparatus 100, i.e., the printer 201, is in a second installation state that is different from the first installation state.

In the first embodiment, the first installation state is a state where the printer apparatus 100 is installed with the recording medium discharge opening 106 facing vertically upward in the printer apparatus 100. In the first embodiment, the second installation state is a state where the printer apparatus 100 is installed with the recording medium discharge opening 106 being in an orientation that crosses the vertical orientation, i.e., faces forward toward the user of the printer 201.

The first recording medium holding unit 402 is curved at a curvature that is equal to or larger than that of the maximal outer diameter of the recording medium 202 wound in a roll to be accommodated in the recording medium accommodating unit 301, and is a member that has a curved shape of which a lower end protrudes downward when the printer 201 is in the first installation state. The first recording medium holding unit 402 may be implemented by a portion of the bottom portion of the recording medium accommodating unit 301.

Thus, when the printer 201 is in the first installation state, the recording medium 202 wound in a roll is moved by its own weight as the recording medium 202 is consumed such that the recording medium 202 is received in the lower end of the curved aspect formed by the first recording medium holding unit 402. In the first embodiment, the first recording medium holding unit 402 frontally faces the printer cover 105 and is a curved aspect that is curved such that a portion thereof that is more central becomes more distant from the printer cover 105. The first recording medium holding unit 402 may be implemented by a portion of the bottom portion of the recording medium accommodating unit 301.

The second recording medium holding unit 403 is curved at a curvature that is equal to or larger than that of the maximal outer diameter of the recording medium 202 wound in a roll to be accommodated in the recording medium accommodating unit 301; and may be implemented by a member that forms a curved aspect of which a lower end protrudes downward when the printer 201 is in the second installation state.

Thus, when the printer 201 is in the second installation state, the recording medium 202 wound in a roll is moved by its own weight as the recording medium 202 is consumed such that the recording medium 202 is received in the lower end of the curved aspect formed by the second recording medium holding unit 403. In the first embodiment, the second recording medium holding unit 403 may be implemented by a wall surface provided standing such that the wall surface crosses the printer cover 105.

When the printer cover 105 is fixed to the casing main body 104, a recording medium conveyance path 404 is formed in the casing 101. The recording medium conveyance path 404 communicatively connects the recording medium accommodating unit 301 and the recording medium discharge opening 106. The recording medium conveyance path 404 communicatively connects the recording medium accommodating unit 301 and the recording medium discharge opening 106 through the printing unit 401.

The printing unit 401 prints characters, etc., on the recording medium 202 conveyed from the recording medium accommodating unit 301 to the recording medium discharge opening 106. The printing unit 401 is not limited to one that prints characters, and may print items other than characters such as symbols, given logo marks, and other images. In the first embodiment, the printing unit 401 prints under a thermal printing scheme.

The printing unit 401 includes a printing head 401*a* and a platen 401*b*. The printing head 401*a* and the platen 401*b* are disposed facing each other sandwiching the recording medium conveyance path 404 therebetween. For example, the printing unit 401 that prints under a thermal printing scheme may include a thermal-printing-scheme printing head (thermal head) 401*a* and the platen 401*b*.

For example, the thermal-printing-scheme printing head (thermal head) 401*a* includes multiple heating elements arranged in a line along the width direction of the recording medium 202, selectively energizes the heating elements to selectively cause the heating elements to heat and thereby, prints characters, etc. The printer 201 including the printing unit 401 that prints under a thermal printing scheme as described above uses the recording medium 202 that has a thermal color developing property. The thermal-printing-scheme printing head 401*a* and a control method of the printing head 401*a* may be implemented easily using various known techniques and therefore, will not be described.

The platen 401*b* has a substantially columnar shape having an axial center direction crossing the direction of the conveyance of the recording medium 202 (a direction penetrating the paper hereof FIG. 4). An end of a shaft of the platen 401*b* is fitted with a gear 203. The gear 203 is rotated by a driving force transmitted to the gear 203 from a motor M that is provided in the casing main body 104. The platen 401*b* rotates with the rotation of the gear 203. The motor M and the gear 203 are engaged through a gear not depicted.

The platen 401*b* faces the printing head 401*a* sandwiching therebetween the recording medium 202 that is conveyed in the recording medium conveyance path 404, and during printing, supports the recording medium 202 from a back surface against a printing force induced by the printing head 401*a*. The platen 401*b* conveys the printed recording medium 202 from the recording medium accommodating unit 301 to the recording medium discharge opening 106 by rotating about the axial center.

In the recording medium conveyance path 404, a cutting mechanism 405 is provided at a position that is closer to the recording medium discharge opening 106 than the printing unit 401. The cutting mechanism 405 includes a fixed blade 405*a* whose position is fixed and a moveable blade, not depicted, provided at a position such that the moveable blade faces the fixed blade 405*a* sandwiching the recording medium conveyance path 404 therebetween. The fixed blade 405*a* is provided on the printer cover 105. The moveable blade is provided movably in directions causing the moveable blade to come into contact with and move away from the fixed blade 405*a*. The moveable blade is provided in the casing main body 104.

In the first embodiment, the moveable blade is provided in a moveable blade unit 405*b* that is configured by integrating the moveable blade and mechanisms to move the moveable blade into one unit. The moveable blade unit 405*b* is detachably provided in the casing main body 104. When the moveable blade is worn or when any of the mechanisms to move the moveable blade become aged, the moveable blade unit 405*b* may be replaced.

When the recording medium 202 is positioned between the fixed blade 405*a* and the moveable blade, the cutting mechanism 405 cuts the recording medium 202 positioned between the fixed blade 405*a* and the moveable blade by causing the moveable blade to come into contact with the fixed blade 405*a*. Thereby, the cutting mechanism 405 cuts, at an arbitrary length, the recording medium 202 on which printing has been executed by the printing unit 401.

After cutting the recording medium 202, the cutting mechanism 405 moves the moveable blade in a direction causing the moveable blade to move away from the fixed blade 405*a* to form a gap between the fixed blade 405*a* and the moveable blade. By rotating the platen 401*b* in this state, the recording medium 202 accommodated in the recording medium accommodating unit 301 is sent out being unrolled toward the recording medium discharge opening 106. Thereby, the recording medium 202 may be subjected to the next printing.

The recording medium 202 wound in a roll and accommodated in the recording medium accommodating unit 301 is pulled out starting from an outer circumference and is fed to the printing unit 401 by the rotation of the platen 401*b* to send out the recording medium 202, unrolling toward the recording medium discharge opening 106. The recording medium 202 wound in a roll is rotated in the recording medium accommodating unit 301 by being pulled out starting from the outer circumference. In the recording medium accommodating unit 301, the recording medium 202 wound in a roll is rotated about the shaft around which the recording medium 202 is wound into a roll.

Therefore, in a state where the recording medium 202 wound in a roll can be rotated about the shaft of the recording medium 202, the recording medium accommodating unit 301 accommodates and holds the recording medium 202 wound in a roll. When the recording medium 202 wound in a roll is accommodated in the recording medium accommodating unit 301, the recording medium 202 is held from below in the vertical direction by the first recording medium holding unit 402 or the second recording medium holding unit 403, according to the installation state.

The printer 201 includes a remaining amount detecting mechanism that detects (senses) the remaining amount of the recording medium 202 wound in a roll and accommodated in the recording medium accommodating unit 301. The remaining amount detecting mechanism includes a first detecting unit that detects the remaining amount of the recording medium 202 wound in a roll and held in the first recording medium holding unit 402, and a second detecting unit that detects the remaining amount of the recording medium 202 wound in a roll and held in the second recording medium holding unit 403. The first and the second detecting units are provided such that detection by only one of them is activated.

The printer 201 includes a switching lever 410 (refer to FIG. 5B) that receives switching operations to switch the state of the remaining amount detecting mechanism such that detection by any one among the first and the second detecting units is activated. Which one of the first and the second detecting units is activated is determined by the user of the printer apparatus 100, according to the installation state of the printer apparatus 100, i.e., the printer 201.

The user of the printer apparatus 100 switches the state of the remaining amount detecting mechanism by operating the switching lever 410 according to the installation state of the printer apparatus 100, i.e., the printer 201, such that any one among the first and the second detecting units is activated. In the printer apparatus 100, the state of the remaining amount detecting mechanism may be switched by operating the switching lever 410 such that detection by both the first and the second detecting units is deactivated. The remaining amount detecting mechanism and a switching mechanism will be described below (with reference to FIGS. 5A, 5B, and 6 to 8).

The remaining amount detecting mechanism is provided in the casing main body 104 and external to the recording medium accommodating unit 301. The first detecting unit in the remaining amount detecting mechanism detects the remaining amount of the recording medium 202 wound in a roll and held in the first recording medium holding unit 402, through a first window 406 provided in the recording medium accommodating unit 301. The second detecting unit in the remaining amount detecting mechanism detects the remaining amount of the recording medium 202 wound in a roll and held in the second recording medium holding unit 403, through a second window 407 provided in the recording medium accommodating unit 301. FIG. 4 depicts a state where the first detecting unit is activated.

(Configuration of Remaining Amount Detecting Mechanism)

Figure 5A:
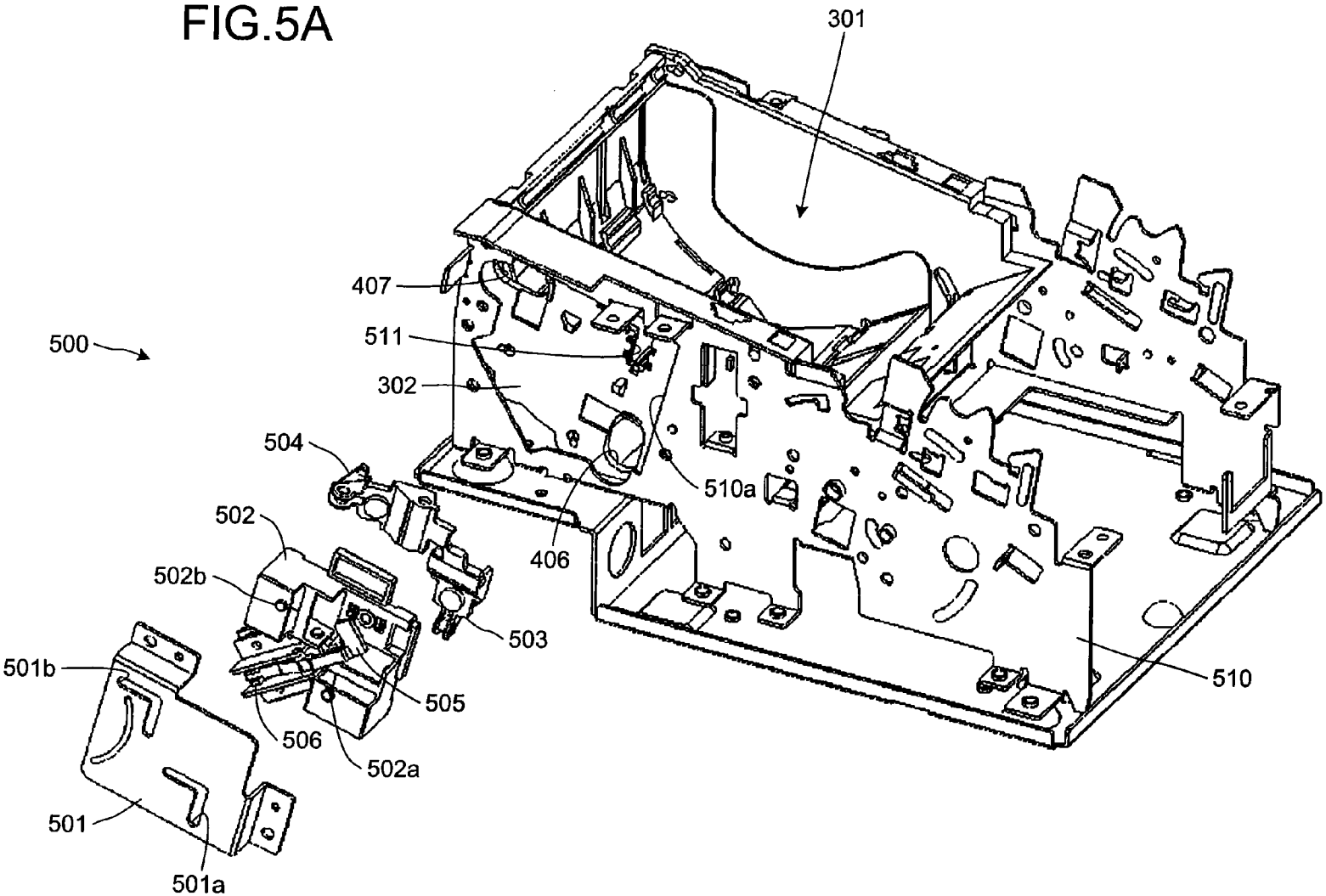
FIG. 5A is a diagram for explaining a remaining amount detecting mechanism (part 1A)
Figure 5B:
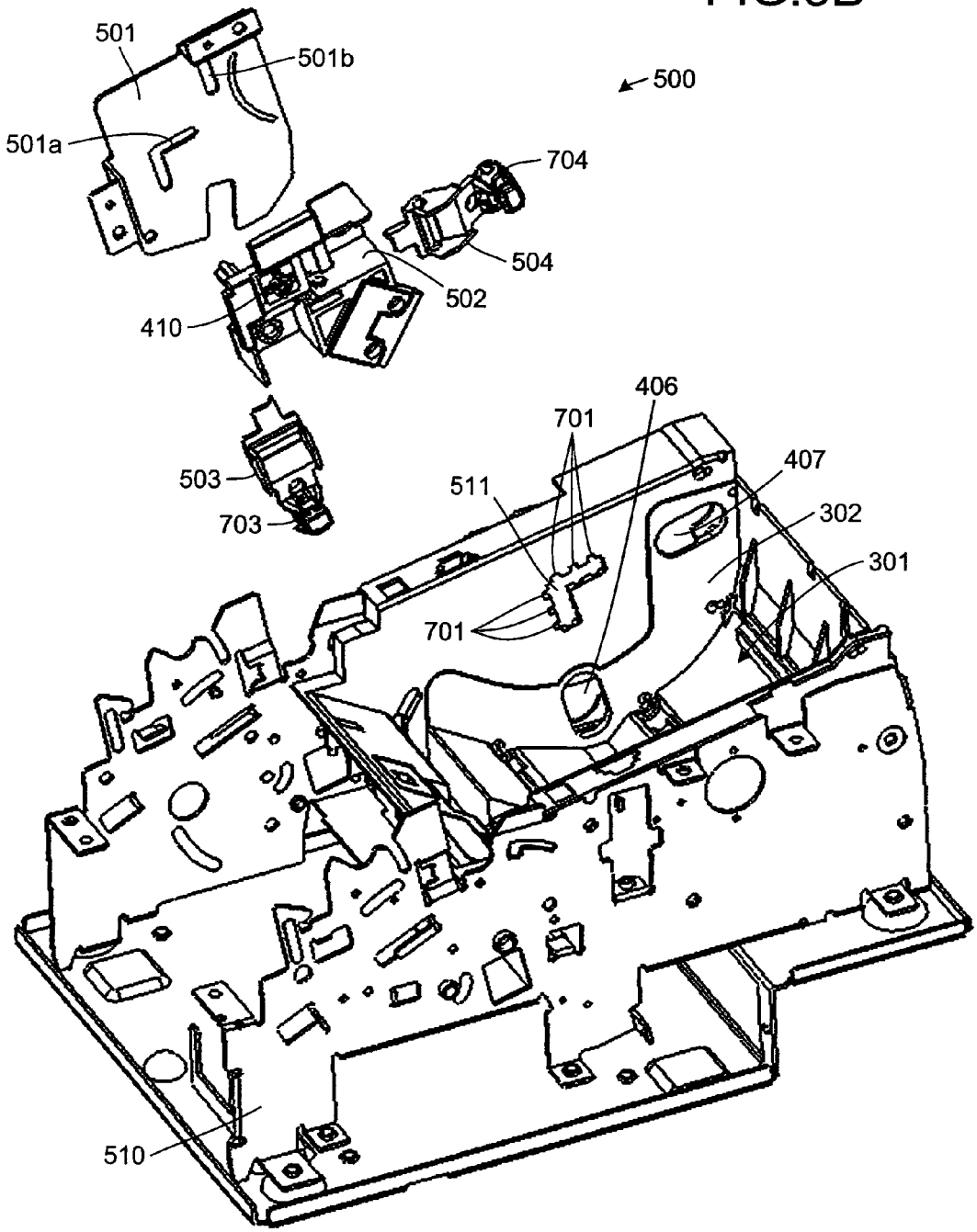
FIG. 5B is a diagram for explaining the remaining amount detecting mechanism (part 1B)
Figure 6:
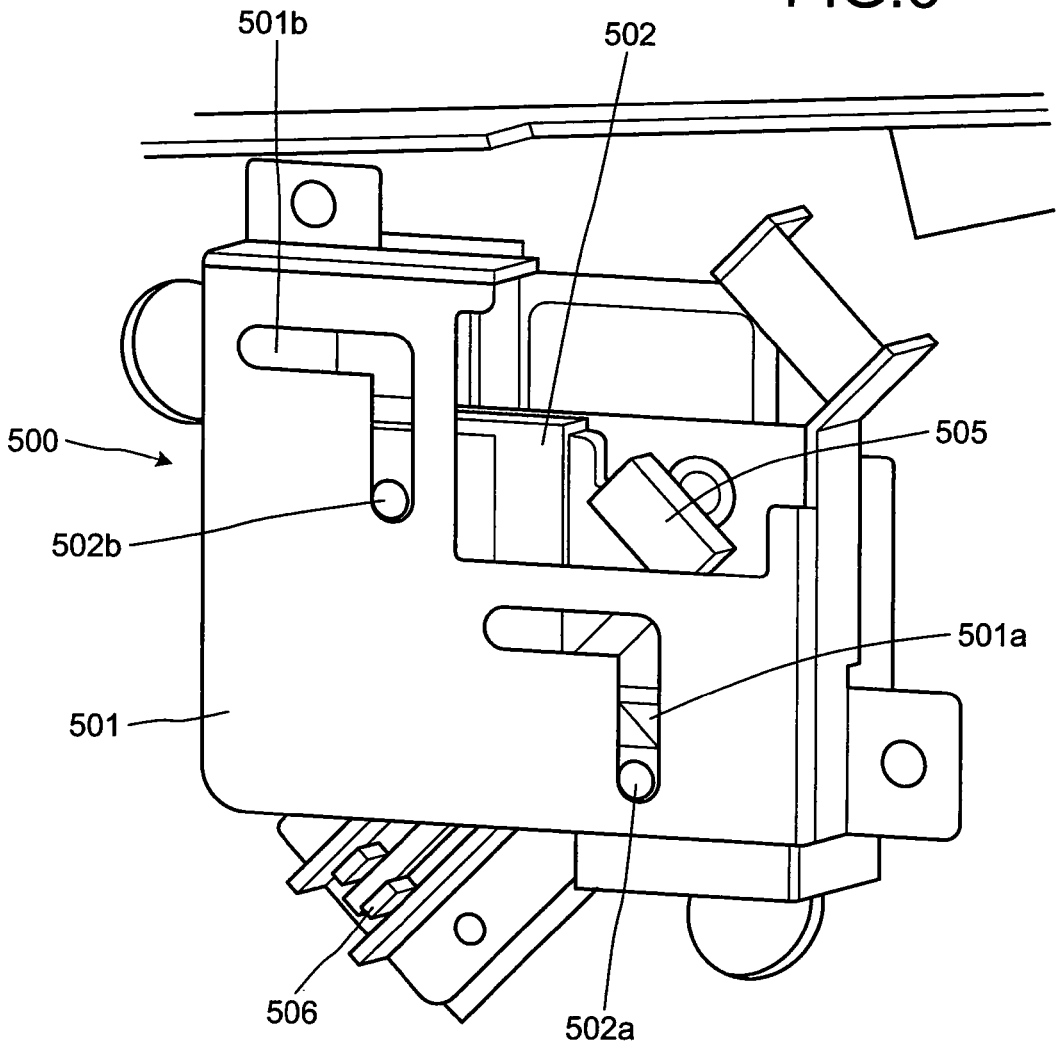
FIG. 6 is a diagram for explaining the remaining amount detecting mechanism (part 2)
Figure 7:
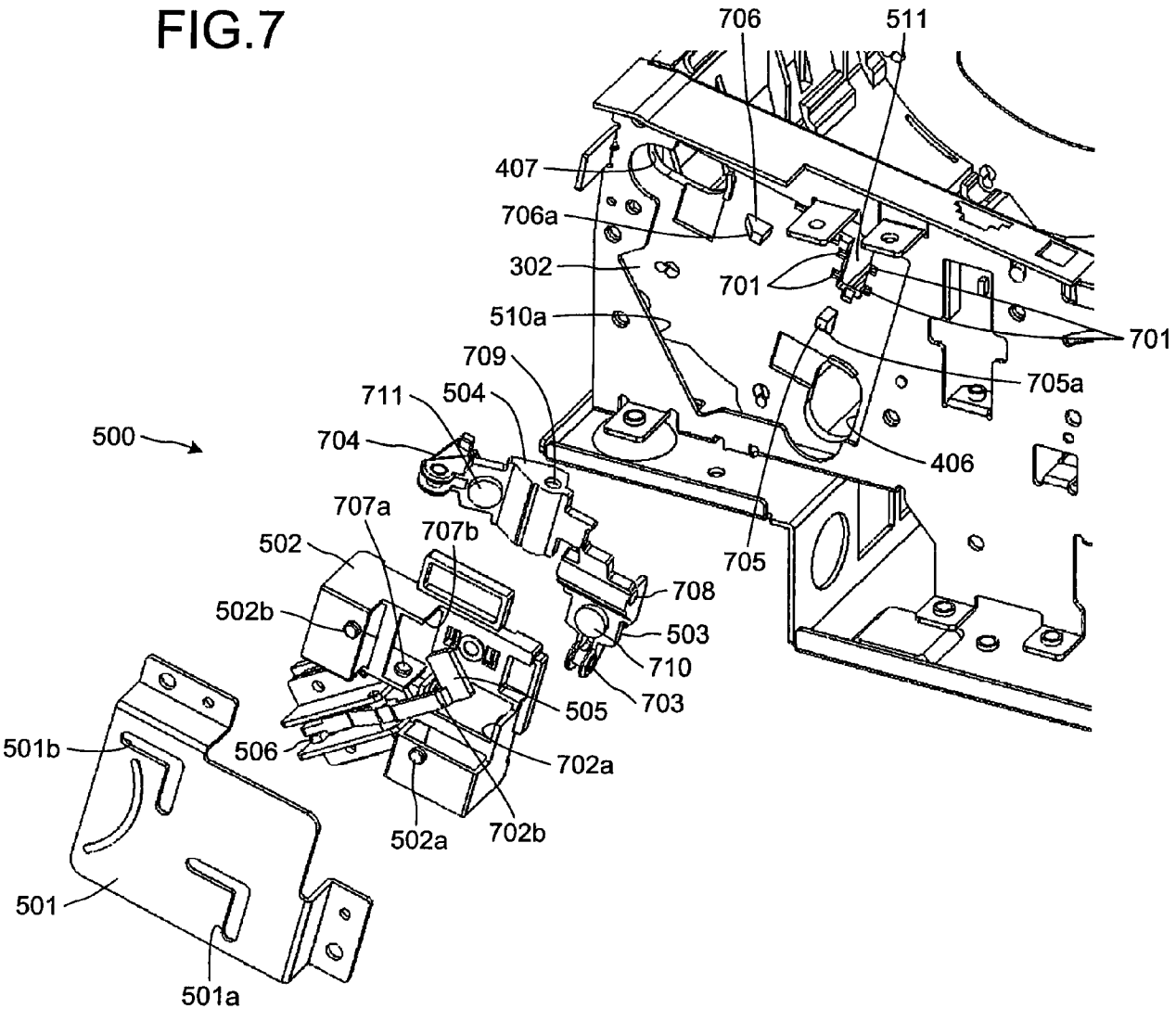
FIG. 7 is a diagram for explaining the remaining amount detecting mechanism (part 3)
Figure 8:
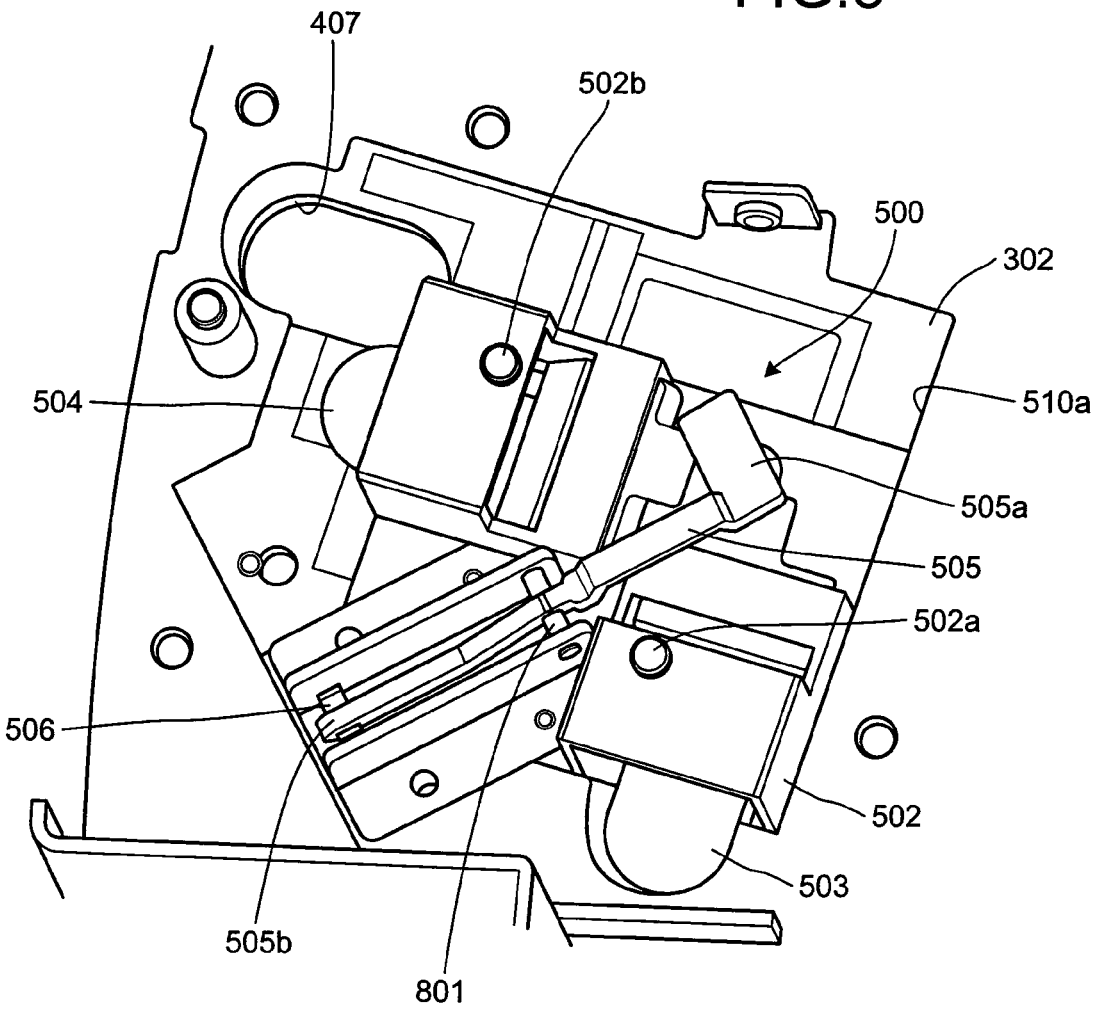
FIG. 8 is a diagram for explaining the remaining amount detecting mechanism (part 4)

The configuration of the remaining amount detecting unit will be described. FIGS. 5A, 5B, and 6 to 8 are diagrams for explaining the remaining amount detecting mechanism. FIG. 5A depicts the remaining amount detecting mechanism in a disassembled state and the position of the remaining amount detecting mechanism in the printer 201. FIG. 5B depicts the disassembled state of the remaining amount detecting mechanism from a perspective opposite to that depicted in FIG. 5A. FIG. 6 depicts the remaining amount detecting mechanism attached to the printer 201. FIG. 7 is an exploded view of a portion of the remaining amount detecting mechanism depicted in FIG. 5A. FIG. 8 depicts a portion of the remaining amount detecting mechanism attached to the printer 201.

In FIGS. 5A, 5B, and 6 to 8, the remaining amount detecting mechanism 500 is provided in a vicinity of the recording medium accommodating unit 301 in the printer 201. The remaining amount detecting mechanism 500 includes a unit covering member 501, a unit frame member 502, a first detecting lever 503, a second detecting lever 504, an interlocked detecting lever 505, and a detection sensor 506.

In the embodiment, a detecting lever may be implemented by the first and the second detecting levers 503 and 504. In the embodiment, a detection switch may be implemented by the detection sensor 506 and the interlocked detecting lever 505. The unit covering member 501 is provided in the box-shaped member 302 that constitutes the recording medium accommodating unit 301 through an opening 510*a* provided in a main body frame 510 of the printer 201.

The unit frame member 502 is provided between the unit covering member 501 and the box-shaped member 302, and is configured to be movable in a space formed by the unit covering member 501 and the box-shaped member 302. The switching lever 410 is provided being integrated into the unit frame member 502. The switching lever 410 is engaged with a slit 511 provided in the box-shaped member 302 and penetrates the slit 511 toward the recording medium accommodating unit 301.

The switching lever 410 is engaged with the slit 511 being movable along the slit 511. When the switching lever 410 is moved along the slit 511, the position of the unit frame member 502 relative to that of the recording medium accommodating unit 301 changes. The slit 511 has a substantially L-shape, whereby the unit frame member 502 moves along a substantially L-shaped trace.

In the slit 511, a hooking recess 701 is provided between a curved portion and each of the two ends of the slit 511. The switching lever 410 includes a hooking protrusion not depicted that may be hooked in the hooking recess 701. The position of the switching lever 410 in the slit 511 may be stopped by hooking the hooking protrusion in the hooking recess 701.

With such a configuration, the position of the unit frame member 502 relative to that of the recording medium accommodating unit 301 may be adjusted and the position of the unit frame member 502 relative to that of the recording medium accommodating unit 301 may be fixed.

In the first embodiment, the hooking recess 701 is provided at each of five points including the two ends, the curved portion of the slit 511, and two points between the curved portion and the two ends. Thereby, the position of the unit frame member 502 relative to that of the recording medium accommodating unit 301 may be fixed at any one of the five points.

The positions of the hooking recesses 701 are not limited to the above five points. The hooking recesses 701 may be provided at three points including the two ends and the curved portion of the slit 511, or may be provided at more points than the above five points. By increasing the points for the hooking recesses 701, the position of the unit frame member 502 relative to that of the recording medium accommodating unit 301 may be finely adjusted.

The unit frame member 502 includes protrusions 502*a* and 502*b* that are hooked in slits 501*a* and 501*b* provided in the unit covering member 501. The slits 501*a* and 501*b* each have a substantially L-shape similar to the above slit 511 such that the slits 501*a* and 501*b* guide the moving positions of the protrusions 502*a* and 502*b* that move together with the unit frame member 502 by an operation of the switching lever 410.

The protrusions 502*a* and 502*b* provided on the unit frame member 502 and the slits 501*a* and 501*b* that are engaged with the protrusions 502*a* and 502*b* are provided at positions that are different from those of the slit 511 and the switching lever 410 in a direction that the unit covering member 501 and the unit frame member 502 overlap.

When the slit 511 and the switching lever 410 are engaged with each other on the side of the recording medium accommodating unit 301, the slits 501*a* and 501*b* and the protrusions 502*a* and 502*b* are engaged with each other on the side opposite to that of the recording medium accommodating unit 301 and thereby, the box-shaped member 302 and the unit covering member 501 holds the unit frame member 502 sandwiching the unit frame member 502 therebetween and thus, the moving position of the unit frame member 502 may be guided. Thereby, the unit frame member 502 may be moved stably and precisely.

The first detecting lever 503 is coupled to the unit frame member 502 by fitting a first shaft portion 702 including a pair of protrusions 702*a* and 702*b* provided facing each other in the unit frame member 502, into a hole 708. Similarly, the second detecting lever 504 is coupled to the unit frame member 502 by fitting a second shaft portion 707 including a pair of protrusions 707*a* and 707*b* provided facing each other in the unit frame member 502, into a hole 709. The first and the second detecting levers 503 and 504 are provided respectively in the unit frame member 502 swingably about the first and the second shaft portions 702 and 707 as the fulcrums.

The first and the second detecting levers 503 and 504 are coupled to the unit frame member 502 in a state where the axial center directions of the first and the second shaft portions 702 and 707 cross each other. In the first embodiment, the first and the second detecting levers 503 and 504 are provided such that the axial center directions of the first shaft portion 702 that is fitted with the first detecting lever 503 and the second shaft portion 707 that is fitted with the second detecting lever 504 cross each other at 90 degrees upon swinging.

The first detecting lever 503 is provided such that, in a case where the printer 201 is in the first installation state, when the shaft of the recording medium 202 wound in a roll moves as the recording medium 202 is consumed, the first detecting lever 503 swings parallel to the direction of the movement. The second detecting lever 504 is provided such that, in a case where the printer 201 is in the second installation state, when the shaft of the recording medium 202 wound in a roll moves as the recording medium 202 is consumed, the second detecting lever 504 swings parallel to the direction of the movement.

An end of the first detecting lever 503 has a first protrusion 703 that protrudes toward the first window 406, i.e., the recording medium accommodating unit 301. A first compression coil spring, not depicted, is provided between a cylinder-like protrusion 710 provided on the first detecting lever 503 and the unit frame member 502. The first detecting lever 503 is biased in a direction to protrude the first protrusion 703 from the first window 406 by the restoring force of the first compression coil spring.

An end of the second detecting lever 504 has a second protrusion 704 that protrudes toward the second window 407, i.e., the recording medium accommodating unit 301. A second compression coil spring, not depicted, is provided between a cylinder-like protrusion 711 provided on the second detecting lever 504 and the unit frame member 502. The second detecting lever 504 is biased in a direction to protrude the second protrusion 704 from the second window 407 by the restoring force of the second compression coil spring.

The interlocked detecting lever 505 is coupled to the unit frame member 502 by fitting a shaft portion 801 formed protruding from both sides about the center into a hole provided in the unit frame member 502, and is provided in the unit frame member 502 swingably about the shaft portion 801 as the fulcrum. The interlocked detecting lever 505 is provided such that an end 505*a* thereof faces an end opposite to the first protrusion 703 of the first detecting lever 503 and an end opposite to the second protrusion 704 of the second detecting lever 504 and another end 505*b* thereof faces the detection sensor 506.

The shaft portion 801 of the interlocked detecting lever 505 has a helical torsion coil spring, not depicted. The helical torsion coil spring biases the interlocked detecting lever 505 such that the end 505*a* of the interlocked detecting lever 505 abuts the end opposite to the first protrusion 703 of the first detecting lever 503 and the end opposite to the second protrusion 704 of the second detecting lever 504 keeping the other end 505*b* of the interlocked detecting lever 505 away from the detection sensor 506.

The biasing force of the helical torsion coil spring that biases the interlocked detecting lever 505 is set to be weaker than the biasing force of the first compression coil spring that biases the first detecting lever 503 and the biasing force of the second compression coil spring that biases the second detecting lever 504. Therefore, the interlocked detecting lever 505 is biased with respect to the end opposite to the first protrusion 703 of the first detecting lever 503 or the end opposite to the second protrusion 704 of the second detecting lever 504, and swings such that the other end 505*b* comes in a vicinity of the detection sensor 506.

The detection sensor 506 may be implemented by a transmission photoelectric sensor. Output from the detection sensor 506 varies according to the position of the interlocked detecting lever 505 relative to that of the detection sensor 506. The output of the detection sensor 506 varies corresponding to cases where the end 505*a* of the interlocked detecting lever 505 is biased with respect to the end opposite to the first protrusion 703 of the first detecting lever 503 or the end opposite to the second protrusion 704 of the second detecting lever 504, and the other end 505*b* comes in a vicinity of the detection sensor 506 being positioned such that the other end 505*b* obscures a light-emitting unit and a light-receiving unit of the detection sensor 506, and where the first detecting lever 503 resists the restoring force of the first compression coil spring and swings, and the second detecting lever 504 resists the restoring force of the second compression coil spring and swings, and the interlocked detecting lever 505 is swung by the biasing force of the helical torsion coil spring to a position at which the other end 505*b* is moved away from the detection sensor 506.

In the first embodiment, the first detecting unit includes the first detecting lever 503; the first compression coil spring and the interlocked detecting lever 505 that act being interlocked to the swinging of the first detecting lever 503; and the unit frame member 502, and the unit covering member 501, etc., that support these components. In the first embodiment, the second detecting unit includes the second detecting lever 504; the second compression coil spring and the interlocked detecting lever 505 that act being interlocked to the swinging of the second detecting lever 504; and the unit frame member 502, and the unit covering member 501, etc., that support these components.

When the first detecting unit is activated, the first detecting lever 503 is provided such that the first protrusion 703 faces the first window 406. The first detecting lever 503 is provided such that the end opposite to the first protrusion 703 faces the end 505*a* of the interlocked detecting lever 505 in a direction to stack the first detecting lever 503 and the interlocked detecting lever 505.

When the second detecting unit is activated, the second detecting lever 504 is provided such that the second protrusion 704 faces the second window 407. The second detecting lever 504 is provided such that the end opposite to the second protrusion 704 faces the end 505*a* of the interlocked detecting lever 505 in the direction to stack the second detecting lever 504 and the interlocked detecting lever 505.

When the first detecting unit is activated, the first protrusion 703 protrudes into the recording medium accommodating unit 301 through the first window 406. When the first detecting unit is activated and the remaining amount of the recording medium 202 accommodated in the recording medium accommodating unit 301 is of a sufficient amount, the first protrusion 703 abuts a side surface of the recording medium 202 wound in a roll. When the first protrusion 703 abuts the side surface of the recording medium 202 wound in a roll, the first detecting lever 503 resists the restoring force of the first compression coil spring and swings in a direction that the end opposite to the first protrusion 703 moves to move away from the end 505*a* of the interlocked detecting lever 505.

When the second detecting unit is activated, the second protrusion 704 protrudes into the recording medium accommodating unit 301 through the second window 407. When the second detecting unit is activated and the remaining amount of the recording medium 202 accommodated in the recording medium accommodating unit 301 is of a sufficient amount, the second protrusion 704 abuts a side surface of the recording medium 202 wound in a roll. When the second protrusion 704 abuts the side surface of the recording medium 202 wound in a roll, the second detecting lever 504 resists the restoring force of the second compression coil spring and swings in the direction that the end opposite to the second protrusion 704 moves to move away from the end 505*a* of the interlocked detecting lever 505.

In the remaining amount detecting mechanism 500, the switching lever 410 is provided in the unit frame member 502, and the first and the second detecting levers 503 and 504 are provided in the unit frame member 502. Therefore, when the unit frame member 502 is moved by operating the switching lever 410, the first detecting lever 503 and the second detecting lever 504 move interlocked with each other.

Therefore, when the first detecting lever 503 protrudes from the first window 406, the second detecting lever 504 is positioned such that the second detecting lever 504 is retracted from the second window 407. Similarly, when the second detecting lever 504 protrudes from the second window 407, the first detecting lever 503 is positioned such that the first detecting lever 503 is retracted from the first window 406.

In this manner, in the remaining amount detecting mechanism 500, the first and the second detecting units may be moved by operating the switching lever 410 to positions activating detection by any one among the first and the second detecting units alone. In the first embodiment, a moving mechanism includes the switching lever 410 and the slit 511.

The box-shaped member 302 has a first retracting rib 705. The first retracting rib 705 is provided at a position such that the first retracting rib 705 interferes with the first protrusion 703 that is moved by the operation of the switching lever 410 such that the first retracting rib 705 protrudes toward the first detecting lever 503. The first retracting rib 705 includes a first slope portion 705*a* that protrudes more as the first retracting rib 705 becomes farther from the first window 406.

Thus, in a case where the first protrusion 703 protrudes from the first window 406, when the switching lever 410 is operated such that the first protrusion 703 is moved to a position at which the first protrusion 703 is retracted from the first window 406, the first detecting lever 503 is pushed by the first slope portion 705*a* and swings in the direction that the first protrusion 703 moves to approach the unit covering member 501. The first detecting lever 503 swings such that the first protrusion 703 approaches the unit covering member 501 and thereby, the end opposite to the first protrusion 703 of the first detecting lever 503 is moved in the direction that the end moves to move away from the end 505*a* of the interlocked detecting lever 505.

The box-shaped member 302 has a second retracting rib 706. The second retracting rib 706 is provided at a position such that the second retracting rib 706 interferes with the second protrusion 704 that is moved by the operation of the switching lever 410, such that the second retracting rib 706 protrudes toward the second detecting lever 504. The second retracting rib 706 includes a second slope portion 706*a* that protrudes more as the second retracting rib 706 becomes farther from the second window 407.

Thus, in a case where the second protrusion 704 protrudes from the second window 407, when the switching lever 410 is operated such that the second protrusion 704 is moved to a position at which the second protrusion 704 is retracted from the second window 407, the second detecting lever 504 is pushed by the second slope portion 706*a* and swings in the direction that the second protrusion 704 moves to approach the unit covering member 501. The second detecting lever 504 swings such that the second protrusion 704 approaches the unit covering member 501 and thereby, the end opposite to the second protrusion 704 of the second detecting lever 504 is moved in the direction that the end moves to move away from the end 505*a* of the interlocked detecting lever 505.

In this manner, the position of the end opposite to the first protrusion 703 of the first detecting lever 503 or the position of the end opposite to the second protrusion 704 of the second detecting lever 504 is moved by the first and the second retracting ribs 705 and 706 in the direction that the ends move to move away from the end 505*a* of the interlocked detecting lever 505 according to the position of the unit frame member 502 and thereby, the interlocked detecting lever 505 is prevented from mistakenly swinging with the intended swinging of the first or the second detecting lever 503 or 504 in the detecting unit that is not activated.

(Detection of Remaining Amount)

Figure 9:
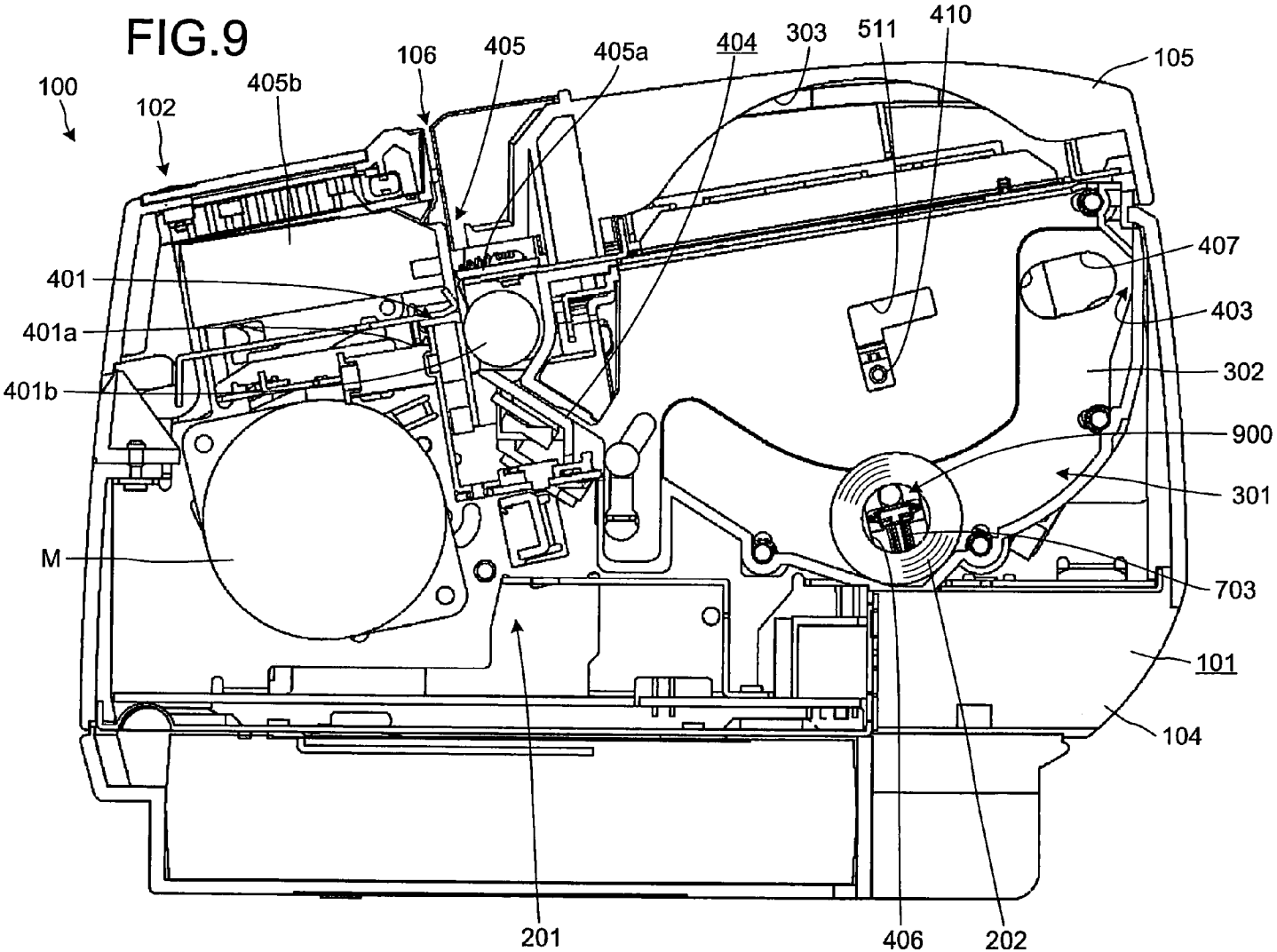
FIG. 9 is a diagram for explaining a detection method used by the remaining amount detecting mechanism.
Figure 10:
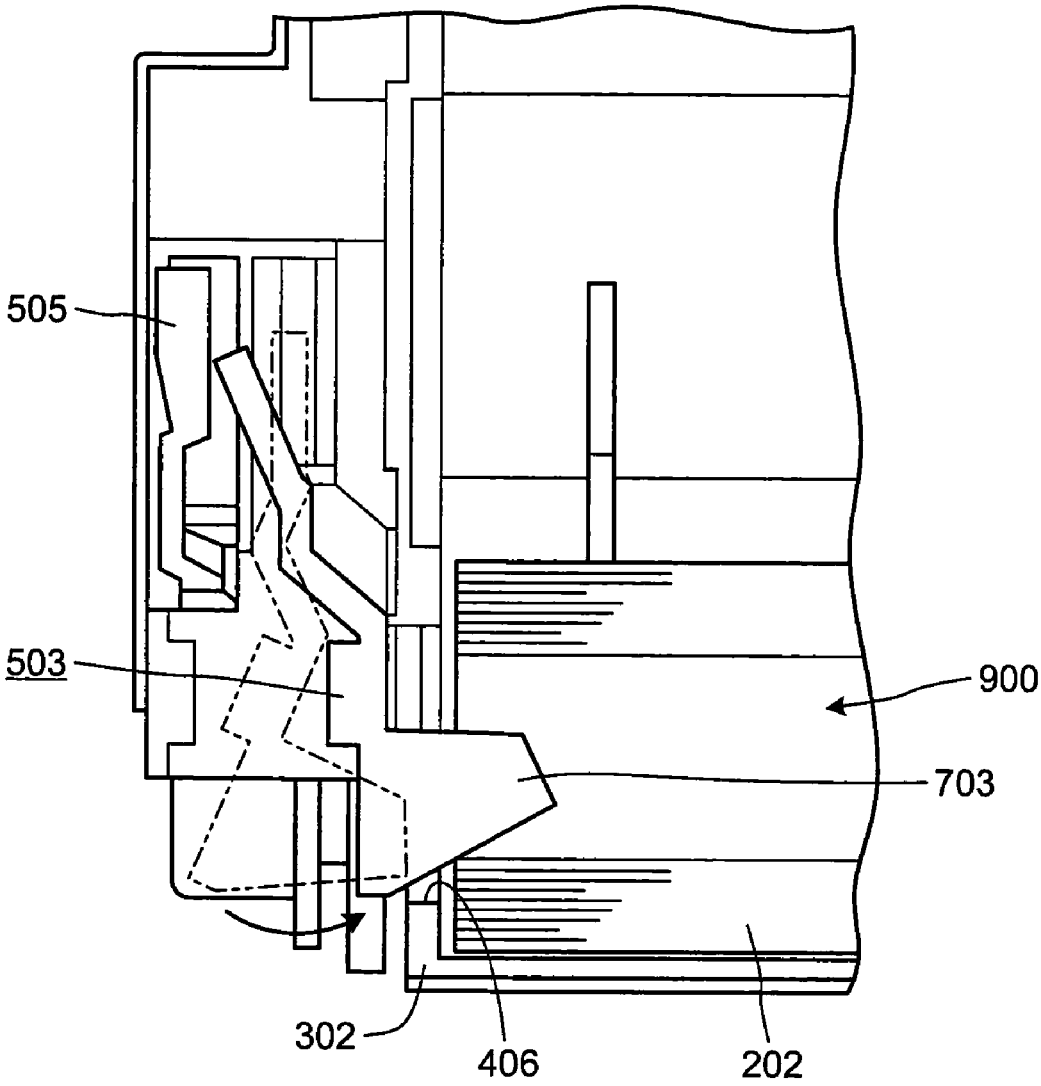
FIG. 10 is a diagram for explaining the detection method used by the remaining amount detecting mechanism.

A detection method used by the remaining amount detecting mechanism 500 will be described. FIGS. 9 and 10 are diagrams for explaining the detection method used by the remaining amount detecting mechanism 500. FIG. 9 depicts a cross section (along the A-A line in FIG. 1) of the printer apparatus 100 when the remaining amount of the recording medium 202 wound in a roll and accommodated in the recording medium accommodating unit 301 is the predetermined amount or less. FIG. 10 depicts a cross section of the printer apparatus 100 along a plane that intersects the axial center of the recording medium 202 wound in a roll and accommodated in the recording medium accommodating unit 301, that is parallel to the axial center, and that is parallel to the swinging direction of the first detecting lever 503.

In FIGS. 9 and 10, a space 900 formed by the core part in the center of the recording medium 202 wound in a roll moves with the consumption of the recording medium 202 held by the first recording medium holding unit 402 such that the space 900 is received by the lower end of the curved aspect formed by the first recording medium holding unit 402, by the weight of the recording medium 202. When the remaining amount of the recording medium 202 accommodated in the recording medium accommodating unit 301 is of a sufficient amount, the first protrusion 703 abuts the side surface of the recording medium 202 wound in a roll.

When the remaining amount of the recording medium 202 accommodated in the recording medium accommodating unit 301 becomes the predetermined amount or less, the first protrusion 703 faces the space 900 formed by the core part in the center of the recording medium 202. The first detecting lever 503 is biased by the first compression coil spring in the direction that the first protrusion 703 moves to protrude toward the recording medium accommodating unit 301 and therefore, at the time when the first protrusion 703 faces the space 900 formed by the core part, the first detecting lever 503 swings such that the first protrusion 703 enters the space 900 (see FIG. 10).

When the first detecting lever 503 swings such that the first protrusion 703 enters the space 900 formed by the core part, the end opposite to the first protrusion 703 of the first detecting lever 503 causes the end 505*a* of the interlocked detecting lever 505 that the end abuts to move toward the unit cover resisting the biasing force of the helical torsion coil spring. Thereby, the interlocked detecting lever 505 swings such that the other end 505*b* approaches the detection sensor 506.

The other end 505*b* of the interlocked detecting lever 505 approaches the detection sensor 506 and thereby, the output of the detection sensor 506 varies. More specifically, the other end 505*b* of the interlocked detecting lever 505 approaches the detection sensor 506 and thereby, the output of the detection sensor 506 varies, for example, from low to high. Based on the output value from the detection sensor 506 or variation in the output of the detection sensor 506, the remaining amount detecting mechanism 500 detects that the remaining amount of the recording medium 202 accommodated in the recording medium accommodating unit 301 is the predetermined amount or less.

In this manner, the remaining amount detecting mechanism 500 of the first embodiment detects that the remaining amount of the recording medium 202 is the predetermined amount or less by detecting the position of the core part based on an assumption that the number of turns of the recording medium 202 wound in a roll decreases as the recording medium 202 is consumed and concurrently, the diameter of the recording medium 202 becomes smaller; whereby, the core part moves.

When the remaining amount detecting mechanism 500 detects that the remaining amount of the recording medium 202 accommodated in the recording medium accommodating unit 301 is the predetermined amount or less, the printer apparatus 100 displays a warning on the liquid crystal displaying unit 110 and causes the LED lamp 109 to blink in red. The printer apparatus 100 also drives the sound output apparatus and outputs a predetermined notification sound. Thereby, the printer apparatus 100 may give notification that the remaining amount of the recording medium 202 is the predetermined amount or less.

In the above description, the detection method used in the remaining amount detecting mechanism 500 has been described taking an example of a case where the remaining amount of the recording medium 202 held by the first recording medium holding unit 402 is detected using the first detecting unit. However, the detection method used by the remaining amount detecting mechanism 500 may also be described for a case where the remaining amount of the recording medium 202 held by the second recording medium holding unit 403 is detected using the second detecting unit.

The method of detecting the remaining amount of the recording medium 202 held by the second recording medium holding unit 403 using the second detecting unit is same as that for the above detection of the remaining amount by the first detecting unit and therefore, will not be described. When the remaining amount of the recording medium 202 held by the second recording medium holding unit 403 is detected using the second detecting unit, the second detecting lever 504 protrudes from the second window 407.

The printer 201 in the printer apparatus 100 of the first embodiment includes a control unit, not depicted, that drives and controls the components included in the printer 201. The control unit is provided in the casing 101 of the printer apparatus 100 and may be implemented by, for example, a micro computer that includes memories such as a ROM and a RAM, and a CPU.

The control unit controls the liquid crystal displaying unit 110, the LED lamp 109, and the sound output apparatus based on the result of the detection by the remaining amount detecting mechanism 500. More specifically, when the remaining amount of the recording medium 202 wound in a roll is detected to be the predetermined amount or less based on the output from the detection sensor 506, the control unit drives and controls the liquid crystal displaying unit 110 to display the warning and also drives and controls the LED lamp 109 to blink in red. The control unit further controls the sound output apparatus to output spoken directions or a warning sound.

In this manner, the printer apparatus 100 may assuredly inform a user of the printer that the remaining amount of the recording medium has become the predetermined amount or less, by displaying the warning on the liquid crystal displaying unit 110, causing the LED lamp 109 to blink in red, and outputting spoken directions or a warning sound from the sound output apparatus when the remaining amount of the recording medium 202 wound in a roll is the predetermined amount or less. By giving notification using sound indicating that the remaining amount of the recording medium is the predetermined amount or less, the near end of the recording medium 202 may assuredly be conveyed even when the user is away from the printer apparatus 100.

Figure 11:
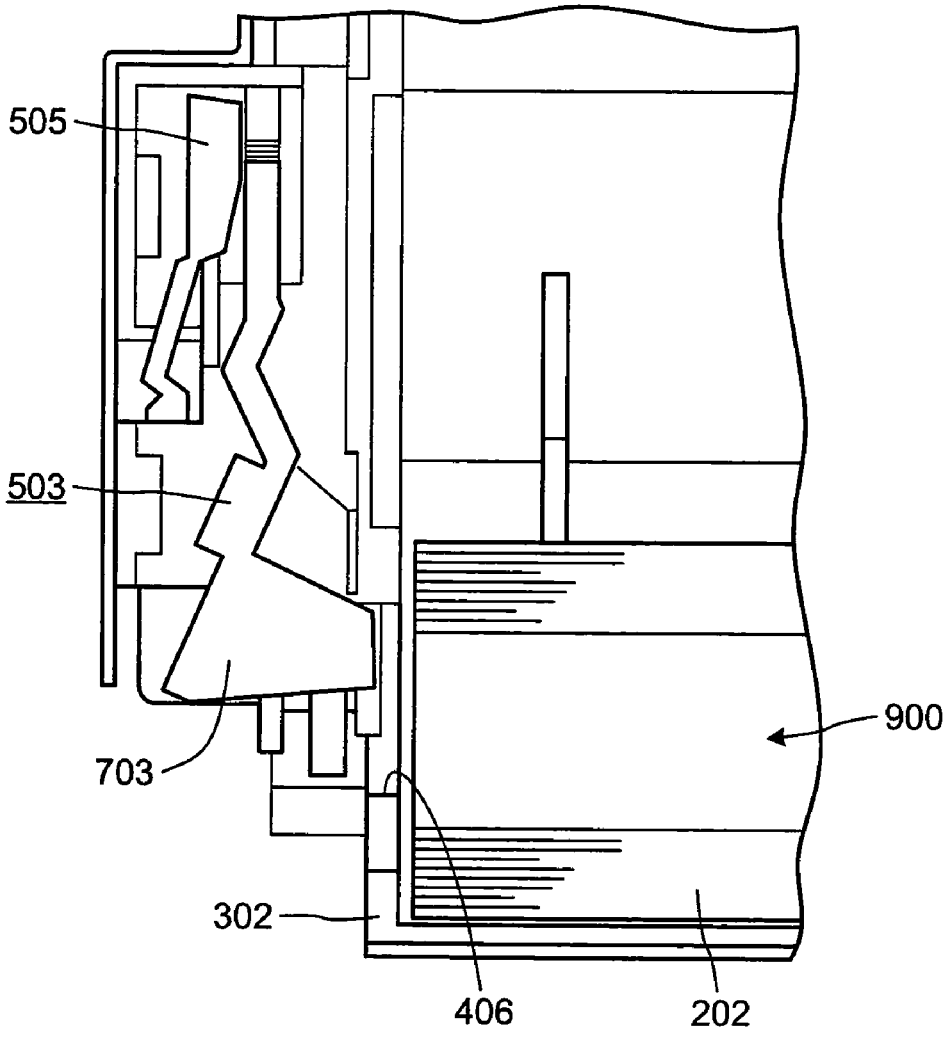
FIG. 11 is a diagram for explaining a first detecting lever and vicinity thereof when a first detecting unit is deactivated.

The first detecting lever 503 used when the first detecting unit is deactivated will be described. FIG. 11 is a diagram for explaining the first detecting lever 503 and vicinity thereof when the first detecting unit is deactivated. In FIG. 11, the first protrusion 703 provided on the first detecting lever 503 is positioned such that the protrusion 703 is retracted from the first window 406 when the first detecting unit is deactivated.

When the first protrusion 703 is moved from a position at which the first protrusion 703 faces the first window 406 to a position at which the first protrusion 703 retracts from the first window 406, the first detecting lever 503 abuts the first slope portion 705*a* of the first retracting rib 705. The first slope portion 705*a* is provided such that the protruded portion of the first slope portion 705*a* becomes larger as the first slope portion 705*a* becomes farther from the first window 406 and therefore, the first protrusion 703 moves along the slope portion in the direction that the first protrusion 703 moves to approach the unit covering member 501 in conjunction with the movement of the first detecting lever 503 to the position at which the first detecting lever 503 retracts from the first window 406.

Thereby, the first detecting lever 503 swings such that its end opposite to the first protrusion 703 moves in the direction that the end moves to move away from the end of the interlocked detecting lever 505. Thereby, the end opposite to the first protrusion 703 of the first detecting lever 503 and the end 505*a* of the interlocked detecting lever 505 are assuredly away from each other, and the interlocked detecting lever 505 is prevented from mistakenly swinging with the swinging of the first detecting lever 503 in the first detecting unit that is not activated.

The printer apparatus 100, i.e., the printer 201 of the first embodiment may deactivate the function of detecting the remaining amount of the recording medium by the remaining amount detecting mechanism 500. The function of detecting the remaining amount of the recording medium by the remaining amount detecting mechanism 500 is deactivated when the first protrusion 703 retracts from the first window 406 and the second protrusion 704 retracts from the second window 407.

In the first embodiment, by positioning the switching lever 410 in the curved portion of the slit 511, the first detecting lever 503 may be positioned such that the first protrusion 703 retracts from the first window 406 and the second detecting lever 504 may be positioned such that the second protrusion 704 retracts from the second window 407.

In this manner, in the printer apparatus 100, i.e., the printer 201 of the first embodiment, both the first and the second detecting units are easily and assuredly deactivated by mere operation of the switching lever 410. Thereby, the function of near end detection is not used and, for example, the remaining amount of the recording medium wound in a roll is determined by visually observing a marking provided at a final portion (a starting portion of the winding) of the recording medium and thereby, notification of the near end not needed by the user of the printer apparatus 100 is not executed.

As described above, according to the printer apparatus 100, i.e., the printer 201 of the first embodiment, the installation orientation thereof may also be adjusted according to the form of use by the user, notification of the near end for each installation orientation may also given, and the detection of the near end may also be deactivated. Therefore, the printer apparatus 100 can cope with various forms of printer use. Thereby, improvement of the general versatility of the printer apparatus 100, i.e., the printer 201, is facilitated.

A case where the detection sensor 506 is implemented by the transmission photoelectric sensor has been described in the first embodiment above. However, the detection sensor 506 is not limited to the transmission photoelectric sensor. More specifically, the detection sensor 506 may also be implemented by, for example, a micro-switch whose output varies corresponding to the presence or absence of contact by the interlocked detecting lever 505.

In the first embodiment above, notification of the near end of the recording medium 202 is given by the display of a warning on the liquid crystal displaying unit 110, blinking of the LED lamp 109, and sound output from the sound output apparatus. However, these notification units are not limited to those that are simultaneously operated. For example, any one of the notification units alone may inform, and any two may also give notification in combination.

As described above, the printer 201 according to the first embodiment is printer that supplies a recording medium 202 wound in a roll, from a recording medium accommodating unit 301 accommodating the recording medium 202 to a printing unit 401 and that prints on the recording medium 202. The recording medium accommodating unit 301 is formed by a first recording medium holding unit 402 that holds the recording medium 202 when the printer 201 is in a first installation state and a second recording medium holding unit 403 that holds the recording medium 202 when the printer 201 is in a second installation state that is different from the first installation state. The printer 201 according to the first embodiment includes a first detecting unit that detects that a core part in the center of the recording medium 202 has reached a predetermined position in consequence of consumption of the recording medium 202 held by the first recording medium holding unit 402; a second detecting unit that detects that the core part in the center of the recording medium 202 has reached a predetermined position in consequence of the consumption of the recording medium 202 held by the second recording medium holding unit 403; and a moving mechanism that moves the first and the second detecting units to positions activating detection by any one among the first and the second detecting units.

According to the printer 201 of the first embodiment, detection by any one among the first and the second detecting units may be activated by moving the first and the second detecting units according to the installation orientation of the printer 201. Thereby, without any complicated control, according to the installation orientation of the printer 201, the detecting unit that is not to be activated is deactivated easily and assuredly.

As described above, by assuredly deactivating the function of the other detecting unit to be deactivated according to the installation orientation of the printer 201, the remaining amount of the recording medium 202 is detected based on the result of the detection by any one among the first and the second detecting units suitable for the installation orientation of the printer 201. Thereby, the remaining amount of the recording medium 202 is detected accurately regardless of the installation orientation of the printer 201.

The printer 201 of the first embodiment characteristically includes the notification units that give notification that the remaining amount of the recording medium 202 is the predetermined amount or less based on the detection result obtained by the first or the second detecting unit. More specifically, the printer 201 of the first embodiment gives notification that the remaining amount of the recording medium 202 is the predetermined amount or less, by displaying a near end message on the liquid crystal displaying unit 110.

According to the printer 201 of the first embodiment, when the core part in the center of the recording medium 202 reaches a predetermined position in consequence of the recording medium 202 being consumed, the notification unit may given notification that the remaining amount of the recording medium is the predetermined amount or less. Thereby, the printer 201 may assuredly inform the user of the printer 201 that the remaining amount of the recording medium 202 is the predetermined amount or less.

The printer 201 of the first embodiment is characterized in that the first and the second detecting units are configured as one unit and the moving mechanism moves the unit. According to the printer 201 of the first embodiment, the first and the second detecting units may be moved collectively. Thereby, detection by any one among the first and the second detecting units is activated easily and assuredly.

The printer 201 of the first embodiment is characterized in that the first and the second detecting units include the first and the second protrusions 703 and 704 that abut and bias the side surface of the recording medium 202 and entering of the first and the second protrusions 703 and 704 into the space of the core part is detected using the movement of the core part in the center of the recording medium 202.

According to the printer 201 of the first embodiment, by determining the mechanical actions of the first and the second protrusions 703 and 704 to be detected, the reaching of a predetermined position may be detected of the core part in the center of the recording medium 202, the core part reaching the predetermined position in consequence of the consumption of the recording medium 202 and the detection not being influenced by the movement of the recording medium 202 associated with the conveyance of the recording medium 202 during printing (such as an irregular movement of the recording medium 202 in the recording medium accommodating unit 301). Thereby, the remaining amount of the recording medium 202 is detected accurately to be the predetermined amount or less.

The printer 201 of the first embodiment is characterized in that the first and the second detecting units optically detect, using the movement of the core part, that the core part in the center of the recording medium 202 has reached the predetermined position. According to the printer 201 of the first embodiment, the physical size of the first and the second detecting units may be a specific size regardless of the position of the core part in the center of the recording medium 202 moved as the recording medium 202 is consumed. Thereby, downsizing of the mechanism related to the detection of the remaining amount of the recording medium 202 is facilitated.

Further, the printer 201 of the first embodiment is printer that supplies a recording medium 202 wound in a roll, from a recording medium accommodating unit 301 accommodating the recording medium 202 to a printing unit 401 and that prints on the recording medium 202. The recording medium accommodating unit 301 is formed by a first recording medium holding unit 402 that holds the recording medium 202 when the printer 201 is in a first installation state and a second recording medium holding unit 403 that holds the recording medium 202 when the printer 201 is in a second installation state that is different from the first installation state. The printer 201 according to the first embodiment includes a first detecting unit that detects that a core part in the center of the recording medium 202 has reached a predetermined position in consequence of consumption of the recording medium 202 held by the first recording medium holding unit 402; a second detecting unit that detects that the core part in the center of the recording medium 202 has reached a predetermined position in consequence of the consumption of the recording medium 202 held by the second recording medium holding unit 403; and a moving mechanism that moves the first and the second detecting units to positions deactivating detection by both the first and the second detecting units.

According to the printer 201 of the first embodiment, detection by both the first and the second detecting units is deactivated by moving the first and the second detecting units. Thereby, detection by both the first and the second detecting units is deactivated easily and assuredly without any complicated control.

According to the printer 201 of the first embodiment, detection by both the first and the second detecting units is deactivated corresponding to the state of use of the printer 201 (such as the installation orientation of the printer 201) and therefore, improvement of the general versatility of the printer 201 is facilitated.

(Second Embodiment)

A printer apparatus of a second embodiment according to the present invention will be described. In the second embodiment, components identical to those in the first embodiment will be given the same reference numerals used in the first embodiment and will not again be described. Compared to the above first embodiment, the printer apparatus of the second embodiment differs in that the printer apparatus of the second embodiment uses a reflection photoelectric sensor in the remaining amount detecting mechanism.

Figure 12:
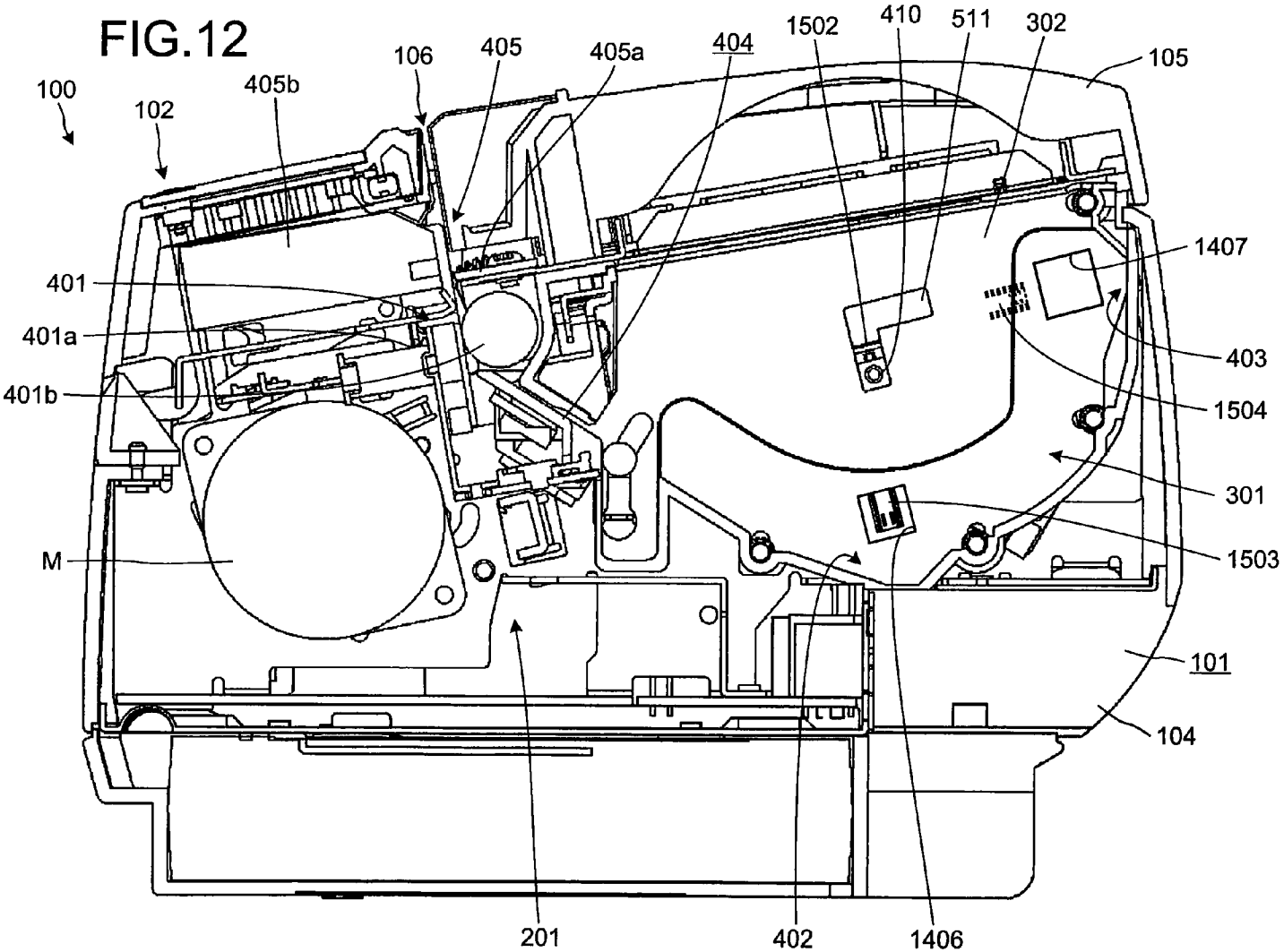
FIG. 12 is a diagram for explaining a printer apparatus according to a second embodiment of the present invention.

FIG. 12 is a diagram for explaining the printer apparatus according to a second embodiment of the present invention. FIG. 12 depicts a cross section (along the A-A line in FIG. 1) of the printer apparatus according to the second embodiment 2 of the present invention. In FIG. 12, the printer apparatus 100 according to the second embodiment 2 of the present invention includes a remaining amount detecting mechanism 1500.

The remaining amount detecting mechanism 1500 includes a first and a second detecting unit. In the remaining amount detecting mechanism 1500, the first detecting unit includes a first detection sensor 1503 that includes a reflection photoelectric sensor constituted of a light-emitting element and a light-receiving element mounted on a substrate. In the remaining amount detecting mechanism 1500, the second detecting unit includes a second detection sensor 1504 that includes a reflection photoelectric sensor constituted of a light-emitting element and a light-receiving element mounted on a substrate.

The first detecting unit in the remaining amount detecting mechanism detects the remaining amount of the recording medium 202 wound in a roll held by the first recording medium holding unit 402, through a first window 1406 provided in the recording medium accommodating unit 301. The second detecting unit in the remaining amount detecting mechanism detects the remaining amount of the recording medium 202 wound in a roll held by the second recording medium holding unit 403, through a second window 1407 provided in the recording medium accommodating unit 301. FIG. 12 depicts a state where the first detecting unit is activated.

The first and the second detection sensors 1503 and 1504 are fixed to a unit frame member 1502. The unit frame member 1502 has the switching lever 410 being integrated therein.

The unit frame member 1502 is provided between the unit covering member 501 and the box-shaped member 302, and is adapted to be movable in a space formed by the unit covering member 501 and the box-shaped member 302. The switching lever 410 is provided on the unit frame member 502 being integrated therewith. The switching lever 410 is engaged with the slit 511 provided in the box-shaped member 302, and penetrates the slit 511 toward the recording medium accommodating unit 301.

The switching lever 410 is engaged with the slit 511 being movable along the slit 511. When the switching lever 410 is moved along the slit 511, the position of the unit frame member 1502 relative to that of the recording medium accommodating unit 301 is varied. The slit 511 has a substantially L-shape and thereby, the unit frame member 1502 moves on a substantially L-shaped trace.

In the slit 511, the hooking recess 701 is provided between a curved portion and each of two ends of the slit 511. The switching lever 410 includes the hooking protrusion that may be hooked in the hooking recess 701. The position of the switching lever 410 in the slit 511 may be stopped by hooking the hooking protrusion in the hooking recess 701.

With such a configuration, the position of the unit frame member 1502 relative to that of the recording medium accommodating unit 301 may be adjusted and the position of the unit frame member 1502 relative to that of the recording medium accommodating unit 301 may be fixed.

When the remaining amount of the recording medium 202 accommodated in the recording medium accommodating unit 301 is of a sufficiently amount, the first detection sensor 1503 faces the side surface of the recording medium 202 wound in a roll. A light beam emitted from the light-emitting element of the first detection sensor 1503 reflects on a side surface of the recording medium 202 wound in a roll and is received by the light-receiving element of the first detection sensor 1503. In this state, the first detection sensor 1503 outputs an output value that is low.

When the remaining amount of the recording medium 202 accommodated in the recording medium accommodating unit 301 is the predetermined amount or less, the first detection sensor 1503 faces the space 900 formed by the core part in the center of the recording medium 202. In this state, the light beam emitted from the light-emitting element of the first detection sensor 1503 is not received by the light-receiving element, and the first detection sensor 1503 outputs an output value that is high.

The remaining amount detecting mechanism 1500 detects that the remaining amount of the recording medium 202 accommodated in the recording medium accommodating unit 301 is the predetermined amount or less, based on the output value from the first detection sensor 1503 or variation in the output of the first detection sensor 1503. The operation of the second detection sensor 1504 is same as that of the first detection sensor 1503 and therefore, will not be described.

In the remaining amount detecting mechanism 1500, the switching lever 410 is provided on the unit frame member 1502 and the first and the second detection sensors 1503 and 1504 are provided on the unit frame member 1502 and therefore, the first and the second detection sensors 1503 and 1504 move with each other when the unit frame member 1502 is moved by operating the switching lever 410.

Therefore, when the first detection sensor 1503 is exposed from the first window 1406, the second detection sensor 1504 is positioned such that the second detection sensor 1504 is retracted from the second window 1407. Similarly, when the second detection sensor 1504 is exposed from the second window 1407, the first detection sensor 1503 is positioned such that the first detection sensor 1503 is retracted from the first window 1406.

When the first detection sensor 1503 is positioned such that the first detection sensor 1503 is retracted from the first window 1406, a light beam emitted from the light-emitting element of the first detection sensor 1503 reflects on a wall surface of a box-shaped member 1302 constituting a recording medium accommodating unit 1301 and is received by the light-receiving element of the first detection sensor 1503. In this state, the first detection sensor 1503 outputs an output value that is low.

Similarly, when the second detection sensor 1504 is positioned such that the second detection sensor 1504 is retracted from the second window 1407, a light beam emitted from the light-emitting element of the second detection sensor 1504 reflects on a wall surface of the box-shaped member 1302 constituting the recording medium accommodating unit 1301 and is received by the light-receiving element of the second detection sensor 1504. In this state, the second detection sensor 1504 outputs an output value that is low.

In this manner, in the remaining amount detecting mechanism 1500, by operating the switching lever 410, the first and the second detecting units are moved to positions activating detection by any one among the first and the second detecting units or to positions deactivating both the first and the second detecting units.

As described above, the printer 201 of the second embodiment is characterized in that the first and the second detecting units are implemented by the first and the second detection sensors 1503 and 1504 that each include the reflection photoelectric sensor constituted of the light-emitting element and the light-receiving element mounted on the substrate, and the reaching of the core part to the predetermined position is optically detected.

According to the printer 201 of the second embodiment, the remaining amount of the recording medium 202 is detected using the first and the second detection sensors 1503 and 1504 each including the reflection photoelectric sensor and thereby, downsizing of the mechanism concerning the detection of the remaining amount is facilitated. Thereby, downsizing of the printer 201 and the printer apparatus 100 including the printer 201 is facilitated.

INDUSTRIAL APPLICATION

As described above, a printer according to the present invention is useful for a printer that holds a recording medium wound in a roll and that prints on the recording medium, and is especially suitable for a printer that may take plural installation orientations.

What is claimed is:

1. A printer that supplies a recording medium wound in a roll, from a recording medium accommodating unit accommodating the recording medium to a printing unit and that prints on the recording medium, wherein the recording medium accommodating unit is formed by a first recording medium holding unit that holds the recording medium when the printer is in a first installation state and a second recording medium holding unit that holds the recording medium when the printer is in a second installation state that is different from the first installation state, and the recording medium accommodating unit includes:

a first detecting unit that detects that a core part in the center of the recording medium has reached a predetermined position in consequence of consumption of the recording medium held by the first recording medium holding unit;

a second detecting unit that detects that the core part in the center of the recording medium has reached a predetermined position in consequence of the consumption of the recording medium held by the second recording medium holding unit; and an activation mechanism that activates detection for either the first detecting unit or the second detecting unit by moving the first and the second detecting units to their respective activation positions corresponding to either the first installation state or the second installation state.

2. The printer according to claim 1, further comprising a notification unit that gives notification that a remaining amount of the recording medium is a predetermined amount or less, based on a detection result obtained by the first or the second detecting unit.

3. The printer according to claim 1, wherein the first and the second detecting units are configured by one unit, and the activation mechanism moves the unit.

4. The printer according to claim 2, wherein the first and the second detecting units are configured by one unit, and the activation mechanism moves the unit.

5. The printer according to claim 1, wherein the first and the second detecting units each comprises a protrusion that biases and abuts a side surface of the recording medium, and each detects entrance of the protrusion into a space of the core part in the center of the recording medium by a movement of the core part.

6. The printer according to claim 2, wherein the first and the second detecting units each comprises a protrusion that biases and abuts a side surface of the recording medium, and each detects entrance of the protrusion into a space of the core part in the center of the recording medium by a movement of the core part.

7. The printer according to claim 3, wherein the first and the second detecting units each comprises a protrusion that biases and abuts a side surface of the recording medium, and each detects entrance of the protrusion into a space of the core part in the center of the recording medium by a movement of the core part.

8. The printer according to claim 4, wherein the first and the second detecting units each comprises a protrusion that biases and abuts a side surface of the recording medium, and each detects entrance of the protrusion into a space of the core part in the center of the recording medium by a movement of the core part.

9. The printer according to claim 1, wherein the first and the second detecting units optically detect that the core part in the center of the recording medium has reached the predetermined position by a movement of the core part.

10. The printer according to claim 2, wherein the first and the second detecting units optically detect that the core part in the center of the recording medium has reached the predetermined position by a movement of the core part.

11. The printer according to claim 3, wherein the first and the second detecting units optically detect that the core part in the center of the recording medium has reached the predetermined position by a movement of the core part.

12. The printer according to claim 4, wherein the first and the second detecting units optically detect that the core part in the center of the recording medium has reached the predetermined position by a movement of the core part.

13. A printer that supplies a recording medium wound in a roll, from a recording medium accommodating unit accommodating the recording medium to a printing unit and that prints on the recording medium, wherein the recording medium accommodating unit is formed by a first recording medium holding unit that holds the recording medium when the printer is in a first installation state and a second recording medium holding unit that holds the recording medium when the printer is in a second installation state that is different from the first installation state, and the recording medium accommodating unit comprises:

a first detecting unit that detects that a core part in the center of the recording medium has reached a predetermined position in consequence of consumption of the recording medium held by the first recording medium holding unit;

a second detecting unit that detects that the core part in the center of the recording medium has reached a predetermined position in consequence of the consumption of the recording medium held by the second recording medium holding unit; and a deactivation mechanism that deactivates detection for both the first and the second detecting units by moving the first and the second detection units to their respective deactivation positions.

* * * * *